US006122617A

United States Patent [19]

Tjaden

[11] Patent Number: 6,122,617

[45] Date of Patent: Sep. 19, 2000

[54] PERSONALIZED AUDIO INFORMATION DELIVERY SYSTEM

[76] Inventor: Gary S. Tjaden, 2820 Gleneagle Pointe, Alpharetta, Ga. 30005

[21] Appl. No.: 09/322,421

[22] Filed: May 27, 1999

Related U.S. Application Data

[63] Continuation of application No. 08/680,899, Jul. 16, 1996, Pat. No. 5,915,238.

[51] Int. Cl.[7] ..... G10L 13/08

[52] U.S. Cl. ..... 704/260; 704/270; 704/251; 704/265; 704/235

[58] Field of Search ..... 704/260, 270, 704/235, 278, 279, 275, 251; 379/100, 84; 380/49

[56] References Cited

U.S. PATENT DOCUMENTS

| | | | |
|---|---|---|---|
| 5,040,212 | 8/1991 | Bethards | 704/260 |
| 5,091,931 | 2/1992 | Milewski | 379/100 |
| 5,193,110 | 3/1993 | Jones et al. | 379/84 |
| 5,452,397 | 9/1995 | Ittycheriah et al. | 704/240 |
| 5,500,920 | 3/1996 | Kupiec | 704/270 |
| 5,553,312 | 9/1996 | Gattey et al. | 455/11.1 |
| 5,572,625 | 11/1996 | Raman et al. | 704/260 |
| 5,647,002 | 7/1997 | Brunson | 380/49 |

*Primary Examiner*—Richemond Dorvil
*Assistant Examiner*—Vijay B Chawan
*Attorney, Agent, or Firm*—Troutman Sanders LLP; R. Stevan Coursey

[57] ABSTRACT

An information delivery system for delivery of audible information to a plurality of end-users comprising, in accordance with the preferred embodiments of an apparatus of the present invention, a master controller connected to a plurality of remotely-located information sources and to a plurality of remotely-located end-user information devices. The master controller connects to a plurality of distant local controllers via a data transport network, including a public switched telecommunications network and a broadcast data transport network. Each local controller includes a sound synthesizer which connects to an end-user audio device, such as a loudspeaker system, a tape recorder, or earphone. In accordance with the preferred embodiments of a method of the present invention, the master controller collects textual information items from the plurality of information sources and enables editing of the items' text to replace words which may be improperly converted to speech with phonetic equivalents, to remove references to illustrations, and to insert punctuation where necessary to improve the understandability of speech produced from the items' text. The master controller also enables assignment of categories to each text item based, in part, upon keywords contained in the item. Upon receipt of an information item by a local controller, the text of the item is converted into audio signals for output to an end-user audio device. Because information items are end-user selectable and because audible delivery of an information item is end-user schedulable, the system enables hands-free and eyes-free receipt of desired information items at a time and place determinable by an end-user.

13 Claims, 27 Drawing Sheets

DTN Interface
Information Provider Interface
End-User Information Interface
Power Supply
To AC Source
Controller Bus
Printer Interface
Processor
RAM
Disk Controller
Video Interface
Keyboard Interface
Printer
Floppy Drive
Hard Disk
Monitor
Keyboard
25
21
23
66
70
74
64
40
42
46
48
50
58
62
44
52
54
56
60
22

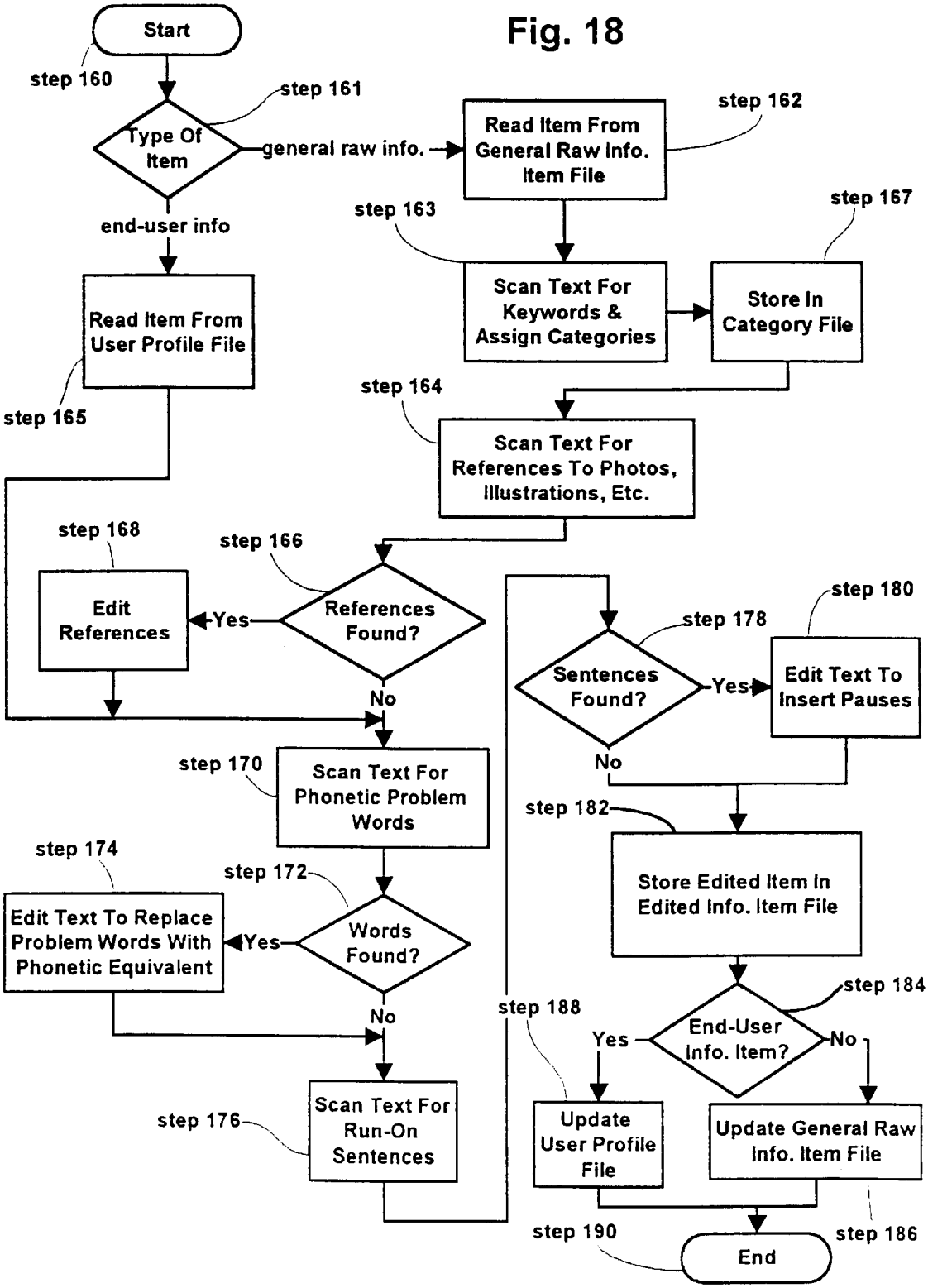
Fig. 18
Start
step 160
step 161
Type Of Item
general raw info.
end-user info
step 162
Read Item From General Raw Info. Item File
step 163
Scan Text For Keywords & Assign Categories
step 167
Store In Category File
Read Item From User Profile File
step 165
step 164
Scan Text For References To Photos, Illustrations, Etc.
step 168
step 166
Edit References
Yes
References Found?
No
step 178
step 180
Sentences Found?
Yes
Edit Text To Insert Pauses
No
step 170
Scan Text For Phonetic Problem Words
step 182
Store Edited Item In Edited Info. Item File
step 174
step 172
Edit Text To Replace Problem Words With Phonetic Equivalent
Yes
Words Found?
No
step 184
step 188
Yes
End-User Info. Item?
No
Scan Text For Run-On Sentences
step 176
Update User Profile File
Update General Raw Info. Item File
step 190
End
step 186

PERSONALIZED AUDIO INFORMATION DELIVERY SYSTEM

This application is a continuation of Ser. No. 08/680,899 filed Jul. 16, 1996, U.S. Pat. No. 5,915,238.

BACKGROUND OF THE INVENTION

This invention relates generally to the field of information delivery systems, and in its preferred embodiments, to the delivery of information in audible form.

Traditionally, news and other information have been delivered to consumers through the print and electronic broadcast media and through postal service delivery of printed or written material. More recently, "on-line" information services, such as CompuServe®, America On-line® and Prodigy® have become available, allowing consumers to access information databases over a public switched telephone network via personal computers equipped with modems. While usage of these media and services for the delivery of news and other information has been very successful, each substantially fails to deliver selectable information in an audible form under end-user control, thereby enabling none of them to fully meet the information delivery needs of consumers.

For instance, the print media offer pre-packaged information of interest to a, presumably, large segment of consumers. However, since the information is presented in textual form with related graphical illustrations, use of the media occupies both the eyes and hands of the user in order to receive news and other information. Thus, print media cannot deliver information to a consumer while the consumer's eyes and hands are otherwise occupied, such as when driving a car. Additionally, because of the time required for printing and physical delivery of printed material, the news and other information may be more than some five to ten hours old by the time it is received by a consumer.

The electronic broadcast media, on the other hand, offer information which is generally more current than that delivered by the print media, but due to the need to broadcast the information, they are generally not tailorable to the needs of individual consumers. In other words, each consumer receives the same information as every other consumer instead of receiving only the information which he/she is interested in receiving. Furthermore, in some cases, news information can be delivered in real time, as the events are occurring. However, in most cases, the information is available to consumers only when a broadcaster decides to present it, which may or may not be at a time when the consumer desires or is able to receive (i.e., by viewing or listening) the information. For example, in the case of a radio broadcast, the user may be unable to listen to the broadcast because their mind is previously occupied performing a task of some sort and, in the case of a television broadcast, the user may be unable to see the broadcast because his/her eyes are occupied by the task.

In the alternative, electronic on-line information services are able to provide a tailored package of information to individual consumers. Such services can allow a user to select information from the provider's database to match the user's interests at the moment. Additionally, the currency of the information can be as good as that of the electronic broadcast media and the information, typically, can be accessed by the user whenever it is convenient for the user to do so. However, current services only provide the information in textual and graphical form for presentation on computer monitors. Thus, the eyes and, usually, the hands of a user must be otherwise unoccupied in order for the user to access and view the information.

Recently, a new type of information delivery service has emerged which combines some of the properties of the print media and some of the properties of the electronic on-line services. This service delivers information tailorable to specific consumers via an electronic data network, or a public switched telephone network, in standard facsimile format for printing on a user's facsimile machine. Because the information is ultimately presented to the user in printed form like the print media, this type of delivery system also requires users to have their hands and eyes otherwise unoccupied if they are to receive the information.

Therefore, there is a need in the industry for a method and an apparatus for delivering user-selected information in audible form which addresses these and other related, and unrelated, problems.

SUMMARY OF THE INVENTION

Briefly described, the present invention comprises an audio information delivery system, including apparatus and methods, for delivering information to a plurality of end-users in audible form More particularly, the present invention includes an audio information system which enables an end-user to receive information, selected according to the end-user's desires and at a time and place of the end-user's option, while freeing the end-user's hands and eyes to allow the end-user to perform other tasks.

In accordance with the preferred embodiments of the apparatus of the present invention, the audio information delivery system includes a master controller, having a storage device, which is in data communication with a plurality of local controllers through a data transport network. The master controller is connectably linked to a plurality of information providers, or sources, including, for example and not imitation, newswire services, magazine publishers, on-line information services, and businesses wishing to communicate with employees. The information providers are, generally, located at sites distant from the master controller. A database, residing in the master controller's storage device, stores information from the plurality of information providers as a plurality of individually unique, information items which correspond, generally, to articles, news accounts, and stories from the plurality of information providers. The database also stores one or more identifiers (also referred to herein as category identifiers), associated with each information item, which define a category of information to which an information item is most closely related (i.e., national news, international news, state news, local news, financial news, internal business news, cooking, home improvement, sports, entertainment, music, movies, television, law, patents, copyrights, trademarks, health, nutrition, etc.). The master controller is also connectably linked to a plurality of end-user input devices through a plurality of communication links. The database additionally stores data acquired via the plurality of end-user input devices and related to each end-user, including, at least, identifiers of information item categories which are of interest to each end-user, end-user information items (i.e., reminders or notes related to, for example, anniversaries, birthdays, appointments, etc.) and, days and times preferred by each end-user for delivery of information items. Note that the term "end-user" as used herein refers to a person for whom a delivery of an information item is intended, as contrasted with other persons who may operate or "use" the system to cause, or assist in, the delivery of information items.

The local controllers are, in accordance with the preferred embodiments of the apparatus of the present invention, located at sites distant from the master controller and include a storage device having a database which stores information items received, in natural language text form, from the master controller. Each local controller of the plurality of local controllers further includes a text-to-speech conversion process and a sound synthesizer device capable of generating output audio signals, on an audio signal channel, representative of speech data corresponding to the natural language text of an information item. An end-user audio device, including for example, but not limitation, an audio tape recorder, an audio loudspeaker, and a headphone set, removably connects to the audio signal channel.

In accordance with preferred embodiments of a method of the present invention, the audio information delivery system periodically establishes data communication connections with the information providers of the plurality of information providers, collects a variety of information items, and stores them in the database located in the master controller's storage device, thereby insuring that the system always maintains a collection of the most current information available from different sources. In cooperation with a system adminstrator, the master controller then associates each information item with one or more category identifiers and edits each information item, if necessary, to remove references to pictures, illustrations, charts, and other graphical material which are, generally, not available when the information item is "spoken" at an end-user's site. Editing also replaces words and/or syllables in the information items which would, typically, be wrongly converted into speech data by a text-to-speech conversion process with words and/or syllables which are phonetically spelled in order to produce their correct conversion into speech data (i.e., data which, when input to a sound synthesizer, produces audible speech having sounds belonging to the variety of different sounds present in a natural language). Such replacement of words with phonetic equivalents (i.e., words/syllables which are intentionally misspelled according to spelling rules of a natural language, but which are converted correctly into speech data representative of spoken words/syllables of the natural language) enables the system to avoid the need to update exception tables which are commonly utilized by most text-to-speech conversion processes to generate speech data for words which are not pronounced, in normal conversation, as they are spelled. By avoiding the distribution of exception table updates from the master controller to a local controller with each information item sent to a local controller for conversion, ultimately, into audible speech, the system reduces delivery time for each information item, reduces data transport network bandwidth requirements, and reduces storage capacity at each local controller below the delivery time, bandwidth, and storage capacity which would, otherwise, be required if exception table updates were necessary.

After editing, information items are delivered from the master controller to each end-user's local controller for temporary storage via a data transport network, according to scheduled delivery days and times previously provided to the master controller (and stored in the master controller's database) by each end-user through an end-user input device. Note that because the information items include, primarily, characters belonging to an alphabet of a natural language text (with conversion into speech data occurring after delivery as described below), the information items are transferred to the plurality of local controllers through use of a data channel having a lower bandwidth than would be required if the information items were transferred in the form of digital speech data. Then, at an end-user's convenience, the end-user's local controller converts the received information items into speech data representative of the information items and produces corresponding audio signals on an audio signal channel for receipt by the end-user's audio device and hearing by the end-user. Because a local controller retains information items until an end-user directs them to be "spoken" and because a local controller may be portable, the information items are presented to the end-user at a time and place of his/her choosing, unlike other traditional information delivery approaches. Additionally, since information items are spoken, an end-user's hands and eyes are to be used for other activities, such as driving or walking, rather than being occupied with reading or watching an information presentation.

The audio information delivery system, in accordance with a first preferred embodiment of an apparatus of the present invention, includes a bi-directional data transport network (i.e., a two-way wired network, including, for example, a public switched telephone network or a public switched data network) which transfers requests for information delivery from a plurality of local controllers to a master controller and transfers packages of information items from the master controller to the appropriate local controllers. According to a first preferred embodiment of a method of the present invention, the master controller periodically assembles a collection, or package, of information items for each end-user based upon identifiers corresponding to categories of information which the end-user desires and upon the information items present in the master controller's database. Each local controller, also periodically, accesses the master controller by sending a message to the master controller via the data transport network. The message identifies the local controller to the master controller and requests that any undelivered packages of information items be delivered to the local controller through the data transport network. Upon receiving a collection of information items, the local controller causes the information items to be converted into audio signals representing the information items and to be recorded on a portable audio medium, such as an audio tape cassette. The end-user then uses the tape cassette to listen to the information on a portable audio cassette player, such as in an automobile audio system.

In accordance with a second preferred embodiment of an apparatus of the present invention, the audio information delivery system includes a uni-directional data transport network (i.e., a one-way wireless network, including, for example, a broadcast data transport network) and a plurality of portable local controllers capable of receiving information items broadcast as messages by a master controller. Each message includes an information item and one or more category identifiers associated with the information item. Each local controller, retains in a database, a plurality of category identifiers representing the types of information items desired by the local controller's end-user. In accordance with a second preferred embodiment of a method of the present invention, the master controller assembles a message for each information item which has not been delivered and then broadcasts the message to the plurality of local controllers. Each local controller simultaneously receives each message broadcast by the master controller and compares the plurality of category identifiers present in the message with the category identifiers stored in its database. Upon finding a message having at least one of the category identifiers stored in its database, the local controller retains the message in its storage device and subsequently, at the end-user's convenience, produces audio signals representing the information item received from the master controller.

It is understood that the scope of the present invention includes embodiments having two-way wired and wireless data transport networks, one-way wired and wireless broadcast data transport networks. Also within the scope of the present invention are embodiments providing for encryption of the information items delivered over the data transport networks to ensure privacy and limit access to only authorized local controllers.

It is further understood that the scope of the present invention encompasses the delivery of music, including music represented very compactly in data formats such as MIDI (Musical Instrument Digital Interface). Such data is transformable into music using technology similar to that which transforms text form information items into audible speech. Various embodiments of the present invention include, for example, but not limitation, delivering music in addition to the textual information items so that the music may be reproduced by a local controller with the spoken information items, making the information items more enjoyable to hear and storing a selection of music in a local controller and automatically inserted music between information articles when the local controller is directed to present the information items and music in audible form Accordingly, it is an object of the present invention to present information to a plurality of end-users while their hands and eyes are otherwise occupied by a task, or activity, of some sort.

Another object of the present invention is to deliver information to a plurality of end-users within minutes of when the information becomes available.

Still another object of the present invention is to deliver information to a plurality of end-users wherever they are located.

Still another object of the present invention is to present information to a plurality of end-users wherever and whenever they chose to receive the information.

Still another object of the present invention is to deliver information to a plurality of end-users which is personalized, including information assembled uniquely for particular end-users.

Still another object of the present invention is to categorize information in order to enable selection of information according to categories of information desired and selected by end-users.

Still another object of the present invention is to edit information to replace words which may be incorrectly converted into speech with phonetic equivalents.

Still another object of the present invention is to edit information to remove references to pictures, illustrations, charts, and other graphical material.

Still another object of the present invention is to insert appropriate punctuation into information items, where necessary, to improve the understandability of the information items once they are converted into speech.

Still another object of the present invention is to remove punctuation from information items, where necessary, to improve the understandability of the information items once they are converted into speech.

Still another object of the present invention is to avoid the necessity of updating exception tables, utilized by most text-to-speech conversion processes, with proper pronunciations of words which would, otherwise, be incorrectly converted into speech data by a text-to-speech conversion process.

Still another object of the present invention is to supply information to a plurality of end-users using a broadcast data transport network.

Still another object of the present invention is to supply information to a plurality of end-users using a public switched telecommunications network.

Still another object of the present invention is to convert information in natural language text form into audible speech.

Still another object of the present invention is to decrease bandwidth requirements necessary to transport information to a plurality of end-users.

Still another object of the present invention is to decrease bandwidth requirements necessary to transport information to a plurality of end-users by transferring information in the form of natural language text to an end-user's site and converting the text into audible speech at the end-user's site, instead of converting the text into digitized speech at the site of the information supplier and transferring the digitized speech to an end-user's site for subsequent conversion into audible speech.

Other objects, features, and advantages of the present invention will become apparent upon reading and understanding the present specification when taken in conjunction with the appended drawings.

BRIEF DESCRIPTION OF THE DRAWINGS

FIG. 18 is a flowchart representation of the categorize and edit application in accordance with the program domain of FIG. 3.

DETAILED DESCRIPTION OF THE PREFERRED EMBODIMENTS

Figure 1:
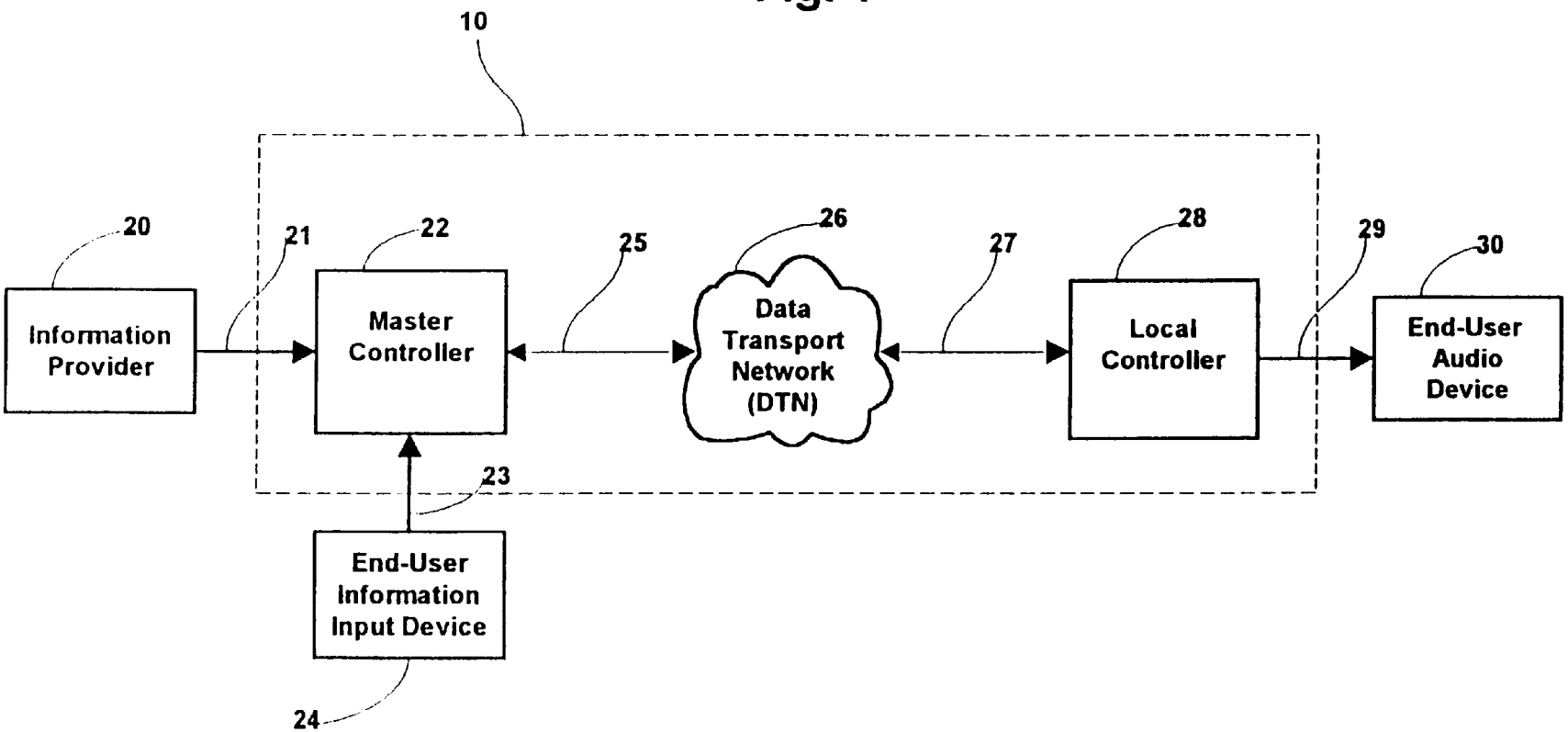
FIG. 1 is a block diagram representation of an audio information delivery system in accordance with a first preferred embodiment of the present invention.

Referring now to the drawings, in which like numerals represent like components throughout the several views, an information delivery system 10, in accordance with the preferred embodiments of the present invention, is shown in block diagram form in FIG. 1. The information delivery system 10 comprises a master controller 22, a data transport network (DTN) 26, and a plurality of local controllers 28 (represented by only one local controller in FIG. 1) which are, generally, located distant from the master controller 22. A data ink 25 bi-directionally connects the master controller 22 to a data transport network (DTN) 26, while data links 27 bi-directionally connect each of the plurality of local controllers 28 to the data transport network 26. A plurality of information providers 20 (represented by only one information provider in FIG. 1) which are also, generally, located distant from the master controller 22, connect to the master controller 22 through data links 21. The master controller 22 also connects, via data links 23, to a plurality of end-user information input devices 24 (represented by only one end-user information input device in FIG. 1) which are, typically, located remote from the master controller 22. An example of an end-user information input device 24, acceptable in accordance with the preferred embodiments, is a personal computer located, preferably, at the end-user's premises. An example of an end-user information input device 24, acceptable in accordance with an alternate embodiment of the present invention, is a telephone voice-response system which is pre-programmed to accept touch-tone telephone responses from end users. Note that each of the data links 21, 23, 25, 27 transports signals representative of computer data using a protocol compatible with the devices connected by the particular data link. Each local controller of the plurality of local controllers 28 connects to an end-user audio device 30 through an audio signal channel 29 which carries conventional audio signals. In accordance with the preferred embodiments of the present invention, examples of end-user audio devices 30 include, but are not limited to, audio tape cassette recorders, audio loudspeakers, and audio headphones.

Figure 2:
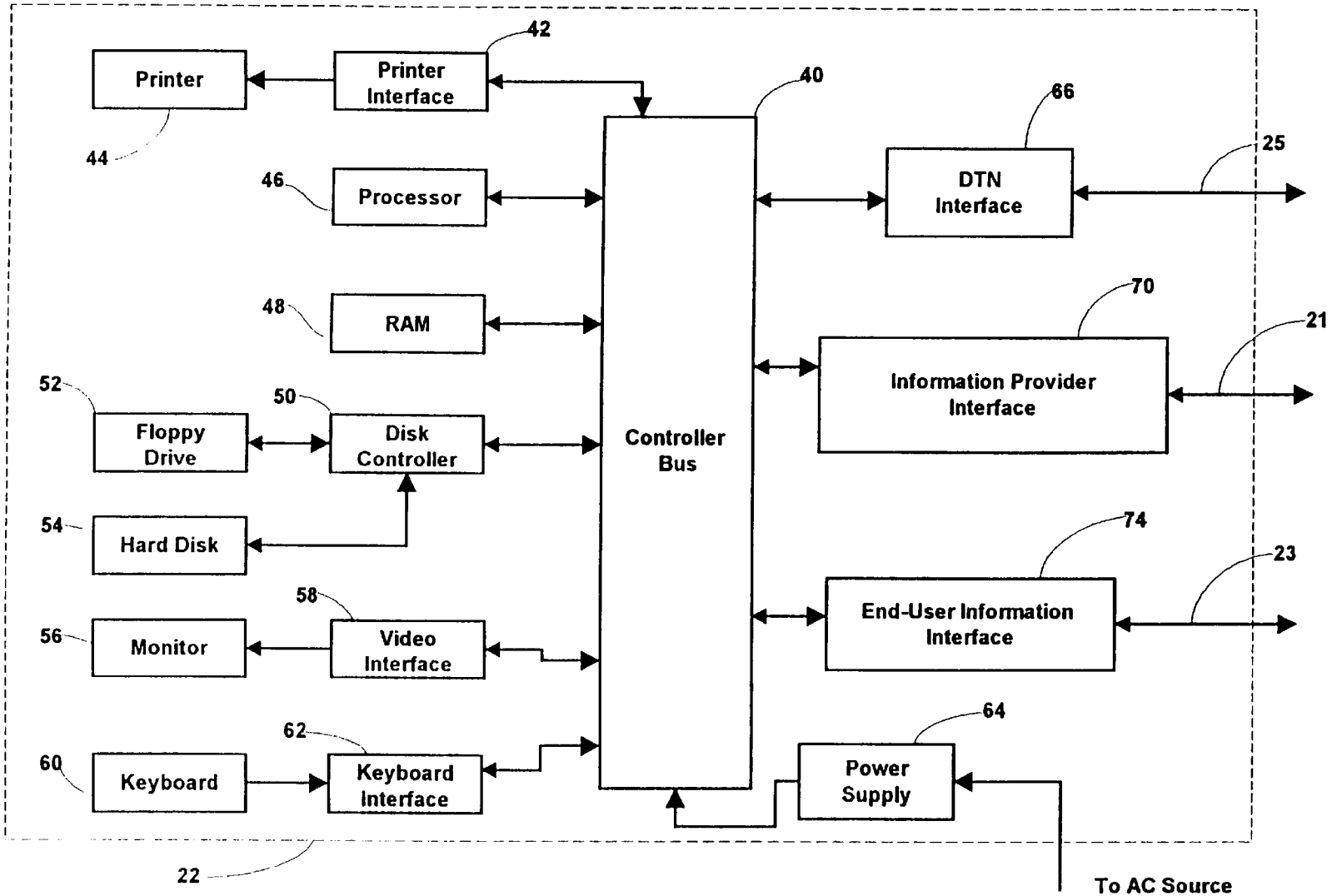
FIG. 2 is a block diagram representation of the master controller of FIG. 1.

FIG. 2 displays a block diagram representation of a master controller 22 in accordance with the preferred embodiments of the present invention. As seen in FIG. 2, the master controller 22 comprises a controller bus 40 which connects to a printer 44 through a printer interface 42. The controller bus 40 connects directly to a processor 46 and random access memory (RAM) 48. A floppy disk drive 52 and a hard disk drive 54 connect to the controller bus 40 via a disk controller 50 which directly interfaces with the controller bus 40. A monitor 56 and keyboard 60 connect to the controller bus 40 through a video interface 58 and a keyboard interface 62, respectively. The controller bus 40 connects to a power supply 64 which connects, preferably, to an alternating-current (AC), electrical energy source (not shown). The controller bus 40 also bi-directionally connects to a data transport network interface 66 which connects to data link 25. An information provider interface 70 bi-directionally connects to the controller bus 40 and is interposed between the controller bus 40 and data links 21, while an end-user information interface 74 bi-directionally connects to the controller bus 40 and to data links 23. In accordance with the preferred embodiments of the present invention, an example of an acceptable master controller 22 is a SPARCstation 20 manufactured by SUN Microsystems, Inc. of Palo Alto, Calif. configured with the various components described above.

Figure 3:
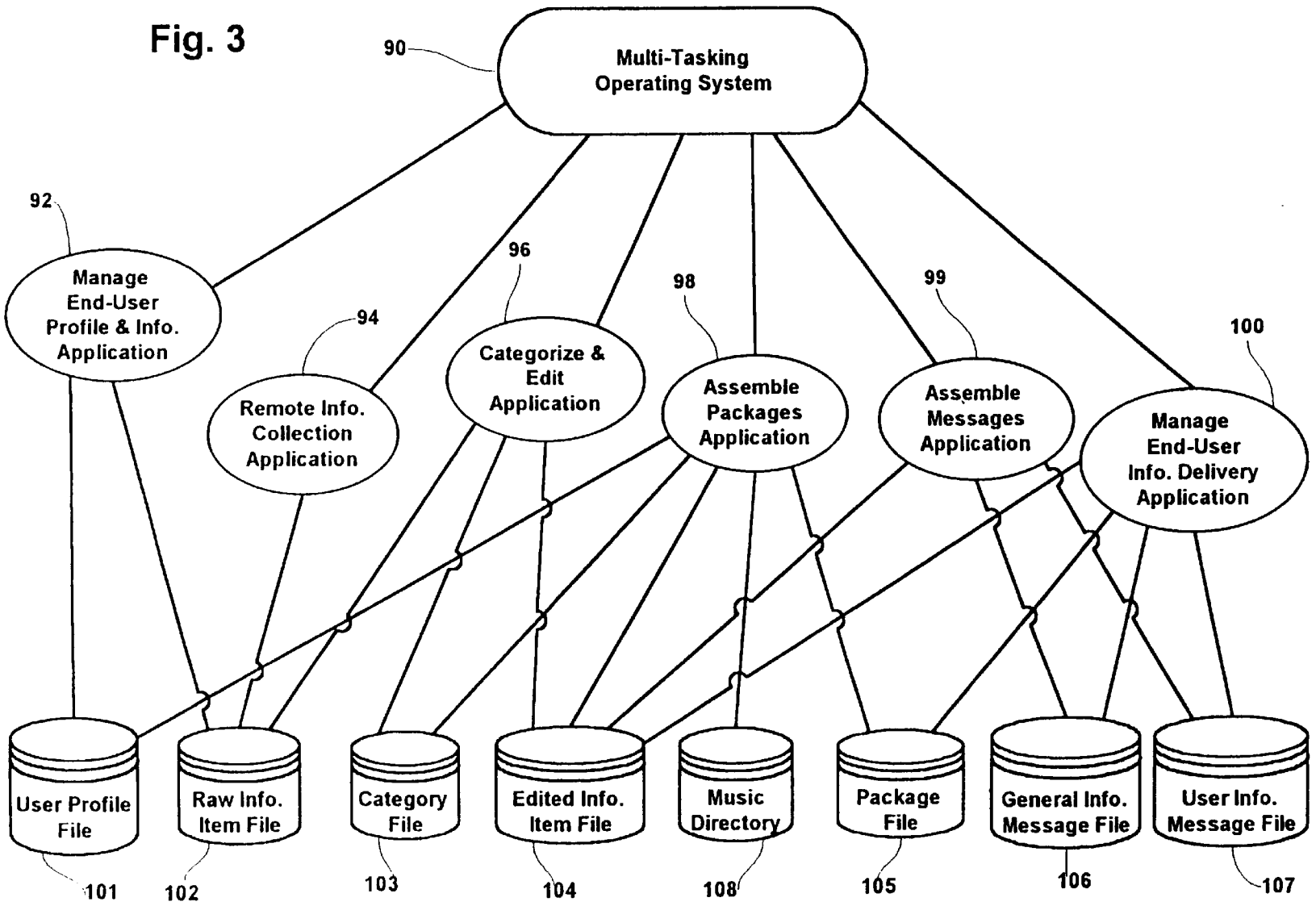
FIG. 3 is a block diagram representation of a program and data domain of the master controller of FIG. 1.

FIG. 3 is a block diagram representation of the program and data domain of the audio information delivery system 10 of the preferred embodiments of the present invention. In the preferred embodiments of the present invention, the program and data domain represents programming found on the master controller 22, which is executed by the master controller's processor 46 using RAM 48, and data files, which are stored in the master controller's hard disk drive 54. Executing, on the master controller 22, in addition to and in communication with a multi-tasking, virtual operating system 90 are: a manage end-user profile and information application 92 (which, when executed by processor 46 employing necessary data files, functions as a means for receiving user information); a remote information collection application 94 (which, when executed by processor 46 employing necessary data files and in conjunction with the information provider interface 70, functions as a means for receiving an information item); a categorize and edit application 96 (which, when executed by processor 46 employing necessary data files and in conjunction with monitor 56 and keyboard 60, functions as a means for categorizing and as a means for editing an information item); an assemble packages application 98 (which, when executed by processor 46 employing necessary data files, functions as a means for selecting an information item); an assemble messages application 99; and, a manage end-user information delivery application 100 (which, when executed by processor 46 employing necessary data files and in conjunction with data transport network interface 66, functions as a means for distributing an information item). One example of a multi-tasking operating system 90, acceptable in accordance with the preferred embodiments of the present invention, is the Solaris operating system available from SUN Microsystems, Inc. of Palo Alto, Calif. The manage end-user profile and information application 92 accesses a user profile file 101 and enables maintenance of data stored in the user profile file 101, including registering an end-user and updating data associated with each end-user. The remote information collection application 94 accesses only the raw information item file 102 and collects and stores information items, in textual form, which are received from a plurality of information providers. The categorize and edit application 96 accesses the raw information item file 102, a category file 103, and an edited information item file 104 in order to enable a system administrator to assign categories to and edit raw information items collected and stored by the remote information collection application 94. Editing generally includes, for example, removing references to figures and charts which are not included in raw information items (Le., because raw information items include only text) and replacing words with phonetic equivalents which will be spoken correctly by the text-to-speech conversion application of a local controller 28. The assemble packages application 98 selects and assembles packages of information items for end-users, accessing the user profile file 101, the category file 103, the edited information item file 104, and a music directory 108, to create packages which it stores in a package file 105. The assemble messages application 99 accesses the edited information item file 104, a general information message file 106, and a user information message file 107 and creates messages from information items for delivery to end-users. The manage end-user information delivery application 100 accesses the edited information item file 104, the package file 105, the general information message file 106, and the user information message file 107 and causes messages, created by the assemble messages application 99, to be delivered to end-users at an appropriate date and time. Note that, in accordance with the preferred embodiments of the apparatus of the present invention, the above described files comprise a database of information.

Figure 4:
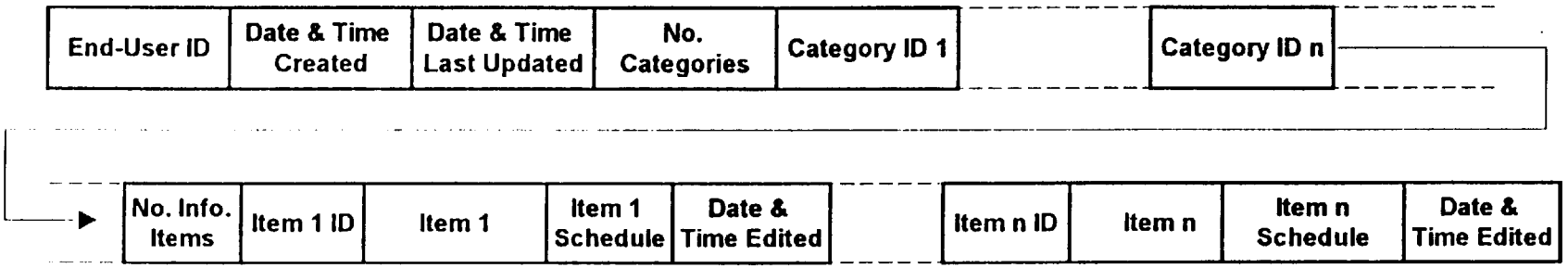
FIG. 4 is a schematic data representation of a user profile record stored in the user profile file of FIG. 3.

The user profile file 101 stores a collection of data for each end-user (referred to herein as a "user profile") which includes categories of information which are of interest to the end-user, information items of a personal nature (referred to herein as "end-user information items" and including such items as birthday reminders, anniversary reminders, etc.), in text form, for delivery to the end-user, and data describing the end-user's preference as to how and when an information item should be delivered by the system 10. Note that the user profile file 101 stores only one record for each end-user of the audio information delivery system 10, thus each record defines a user profile for a different end-user. FIG. 4 displays the structure of each record held by the user profile file 101 in accordance with the preferred embodiments of the present invention. Each record includes: an end-user identifier (unique to each end-user); a date and time representing the date and time when the record was created; a date and time representing the date and time when the record was last updated; a number of information categories of interest to the end-user; an identifier associated with each information category of interest; a number of information items for delivery to the end-user; and, for each information item, an identifier, a description, delivery schedule information, and a date and time representing the date and time when the item was edited by the categorize and edit application 96 (as described below).

Figure 5:
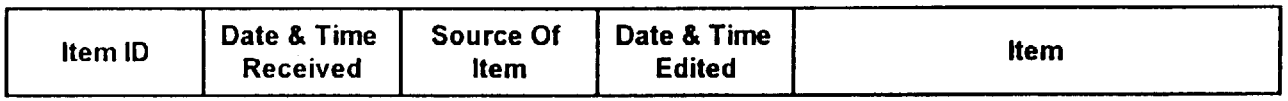
FIG. 5 is a schematic data representation of a general raw information item record stored in the general raw information item file of FIG. 3.

FIG. 5 displays the record layout of each record stored in the raw information item file 102 in accordance with the preferred embodiments of the present invention. The raw information file 102 stores information items, in textual form, as received from the plurality of information providers 20 and with subsequent processing as described below. Note that the raw information item file 102 stores only one record for each raw information item retrieved from an information provider 20. Each record includes: an identifier for and unique to each raw information item; a date and time representing the date and time when the raw information item was received by the system 10; a source identifier designating the source of the raw information item; a date and time representing the date and time when the raw information item was edited; and, a raw information item in textual form.

Figure 6:
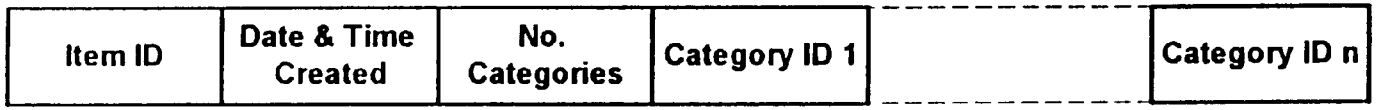
FIG. 6 is a schematic data representation of a category record stored in the category file of FIG. 3.

The category file 103 stores information which identifies the various categories of information to which an information item may belong. For instance, an information item received from a news provider might be an article regarding "free agency law and pro-football". Because the information item discusses a legal issue related to a sport, the information item may be categorized as belonging, at least, to both the "law" and "sports" categories. Thus, the category file 103 would contain an entry for the information item and would include data which identifies the item as belonging to the "law" and "sports" categories. In accordance with the preferred embodiments of the present invention, FIG. 6 shows the data structure of each record retained by the category file 103. Each record includes: an identifier which uniquely identifies an information item; a date and time representing the date and time when the category file record was created; a number of categories to which the information item belongs; and, a list including unique identifiers of the categories to which the information item belongs. Note that the category file 103 includes only one record for each information item received by the system 10.

Figure 7:
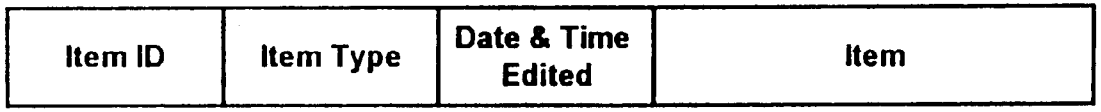
FIG. 7 is a schematic data representation of an edited information item record stored in the edited information item file of FIG. 3.
Figure 8:
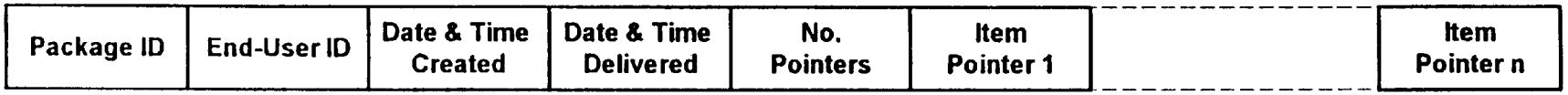
FIG. 8 is a schematic data representation of a package record stored in the package file of FIG. 3.

FIG. 7 illustrates the record structure of the edited information item file 104 in accordance with the preferred embodiments of the present invention. The edited information item file 104 stores (after editing of a raw information item) an edited version of each raw information item which resides in the raw information item file 102. Note that there is only one record in the edited information item file 104 corresponding to each record in the raw information item file 102. In accordance with a preferred method, an editing process (described in more detail below) edits a raw information item, for example, by removing references to figures and charts which are not included in a spoken information item and by replacing words not correctly spoken by a text-to-speech conversion application of a local controller 28 with phonetic equivalents which are correctly spoken by the text-to-speech conversion application. Each record of the edited information item file 104 includes: an identifier which uniquely identifies an information item; a type designator which identifies the information item as a general information item or as an end-user information item; a date and time representing the date and time when the information item was edited; and, the information item in textual form The package file 105 contains a definition of each package which is assembled (described in more detail below) for delivery to an end-user. The items included in each package are selected from the edited information item file 104 and the music directory 108 and match the end-users' profiles and delivery preferences and schedules which are stored in the user profile file 101. In accordance with the preferred embodiments of the present invention, a package definition may contain information items alone or may contain information items which are interspersed with music items stored in the music directory 108. Note that each record in the package file 105 represents only one package. Each record of the package file 105 includes: a package identifier which is unique within the system 10; an end-user identifier which uniquely identifies the end-user who is to receive delivery of the information defined by the package record; a date and time representing the date and time when the package and record were created; a date and time representing the date and time when the package was delivered to the end-user; a number representing the number of pointers to items in the edited information item file 104 and the music directory 108; and, a plurality of pointers corresponding to items in the edited information item file 104 and the music directory 108.

Figure 9:
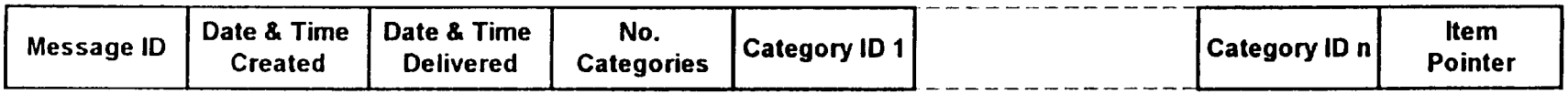
FIG. 9 is a schematic data representation of a general information message record stored in the general information message file of FIG. 3.

FIG. 9 displays, in accordance with the preferred embodiments of the present invention, a record layout of each record included in the general information message file 106. Each record stored in the general information message file 106 represents a message which comprises a category header attached to an information item selected from the edited information item file 104. A method of creating a message is described below. Each record of the general information message file 106 includes: an identifier which is unique for each message stored in the general information message file 106; a date and time representing the date and time when the message was created; a date and time representing the date and time when the message was delivered to an end-user; a number representing the number of categories to which the message belongs; a plurality of identifiers representative of the categories to which the message belongs; and, a pointer to the information item selected for inclusion in the message from the edited information item file 104.

Figure 10:
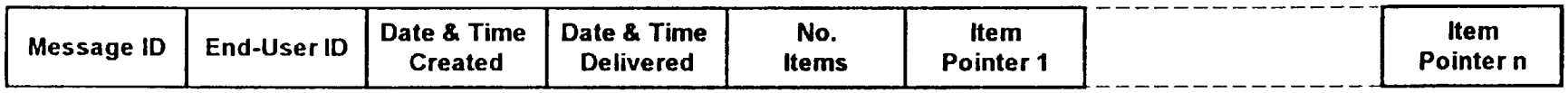
FIG. 10 is a schematic data representation of an end-user information message record stored in the end-user message file of FIG. 3

The user information message file 107 stores data related to messages originating from end-user information items stored in the edited information item file 104. Each record retained by the user information message file 107 represents a message comprising an identification header attached to an end-user information item selected from the edited information item file 104. Messages for inclusion in the user information message file 107 are created by a method described below. FIG. 10 shows a layout of a record, in accordance with the preferred embodiments of the present invention, stored in the user information message file 107. Each record of the user information message file 107 includes: an identifier which is unique for each message stored in the user information message file 107; an identifier which uniquely identifies an end-user of the system 10; a date and time representing the date and time when the message record was created; a date and time representing the date and time when the message was delivered to an end-user; a number representing the number of end-user information items included in the message; and, a plurality of pointers corresponding to an end-user information item selected for inclusion in the message from the edited information item file 104.

Figure 11:
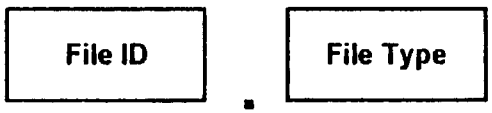
FIG. 11 is a schematic data representation of a file name record stored in the music directory of FIG. 3.

The music directory 108 stores music files for inclusion in packages sent to local controllers, as described above. FIG. 11 shows the format of the names of each file stored in the music directory 108. The file names consist of a file identifier followed by a period (.) and a file type field. For example, a music file to be used as an interlude between spoken textual items might be named "interlude1.mid". In this example, the file type, "mid", indicates that the file is stored in the standard music file format known as MIDI (Musical Instrument Digital Interface).

Figure 12:
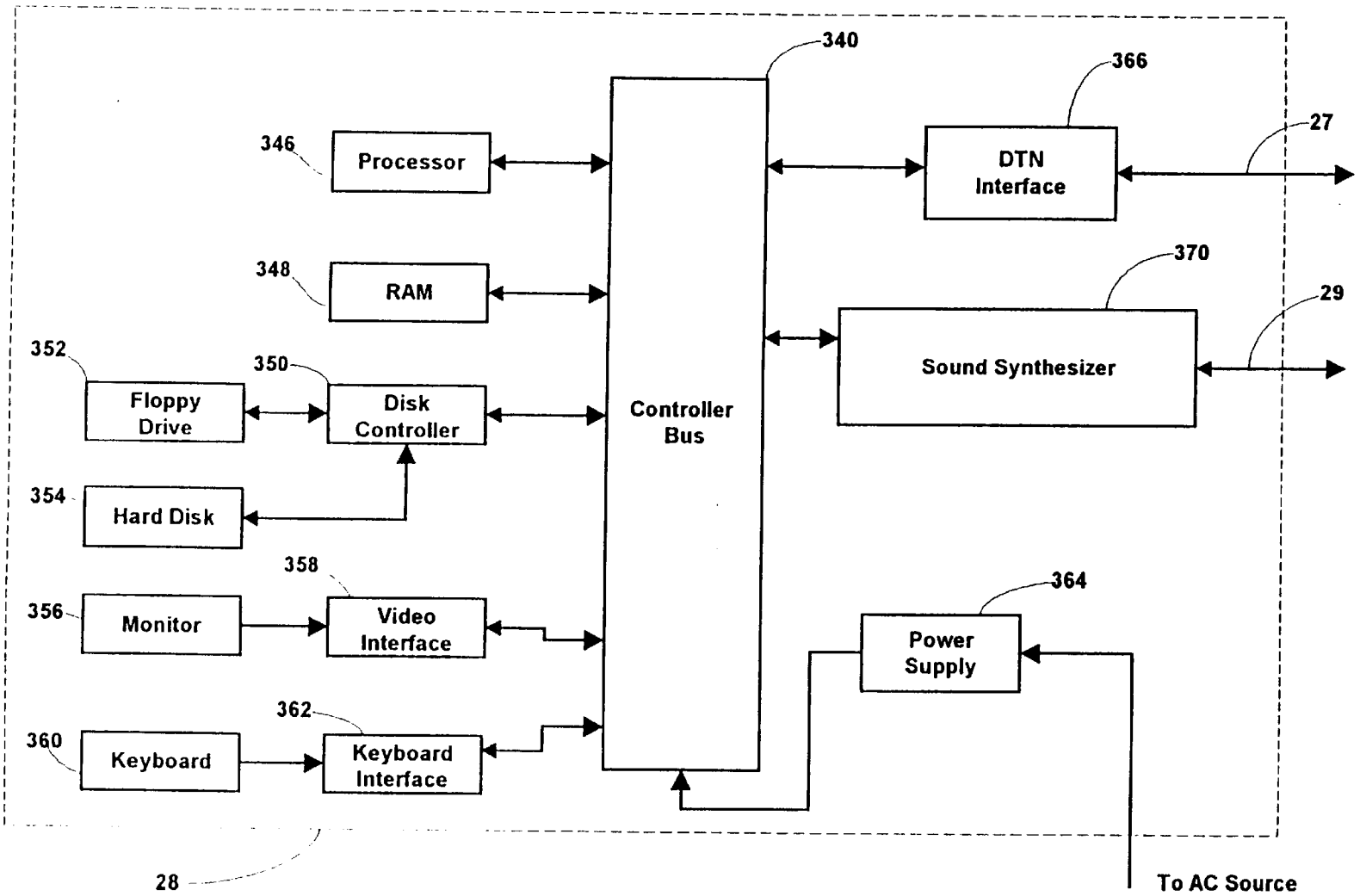
FIG. 12 is a block diagram representation of the local controller of FIG. 1.

A block diagram representation of a local controller 28, in accordance with the preferred embodiments of the apparatus of the present invention, is shown in FIG. 12. The local controller 28 comprises a controller bus 340 which connects directly to a processor 346 and directly to a random access memory (RAM) 348. A floppy disk drive 352 and a hard disk drive 354 connect to the controller bus 340 via a disk controller 350 which directly interfaces with the controller bus 340. A monitor 356 and keyboard 360 connect to the controller bus 340 through a video interface 358 and a keyboard interface 362, respectively. The controller bus 340 connects to a power supply 364 which connects, preferably, to an alternating current (AC), electrical energy source (not shown). The controller bus 340 also bi-directionally connects to a data transport network interface 366 which connects to data link 27. A sound synthesizer device 370 bi-directionally connects to the controller bus 340 and to an end-user audio device 30 via an audio signal channel 29. In accordance with a first preferred embodiment of the apparatus of the present invention, an example of an acceptable local controller 28 is a model Spectria 305 personal computer manufactured by Packard Bell Inc. of Westlake Village, Calif. configured with an internal modem functioning as a DTN interface 366 and a 16-bit sound interface card functioning as a sound synthesizer 370.

Figure 13:
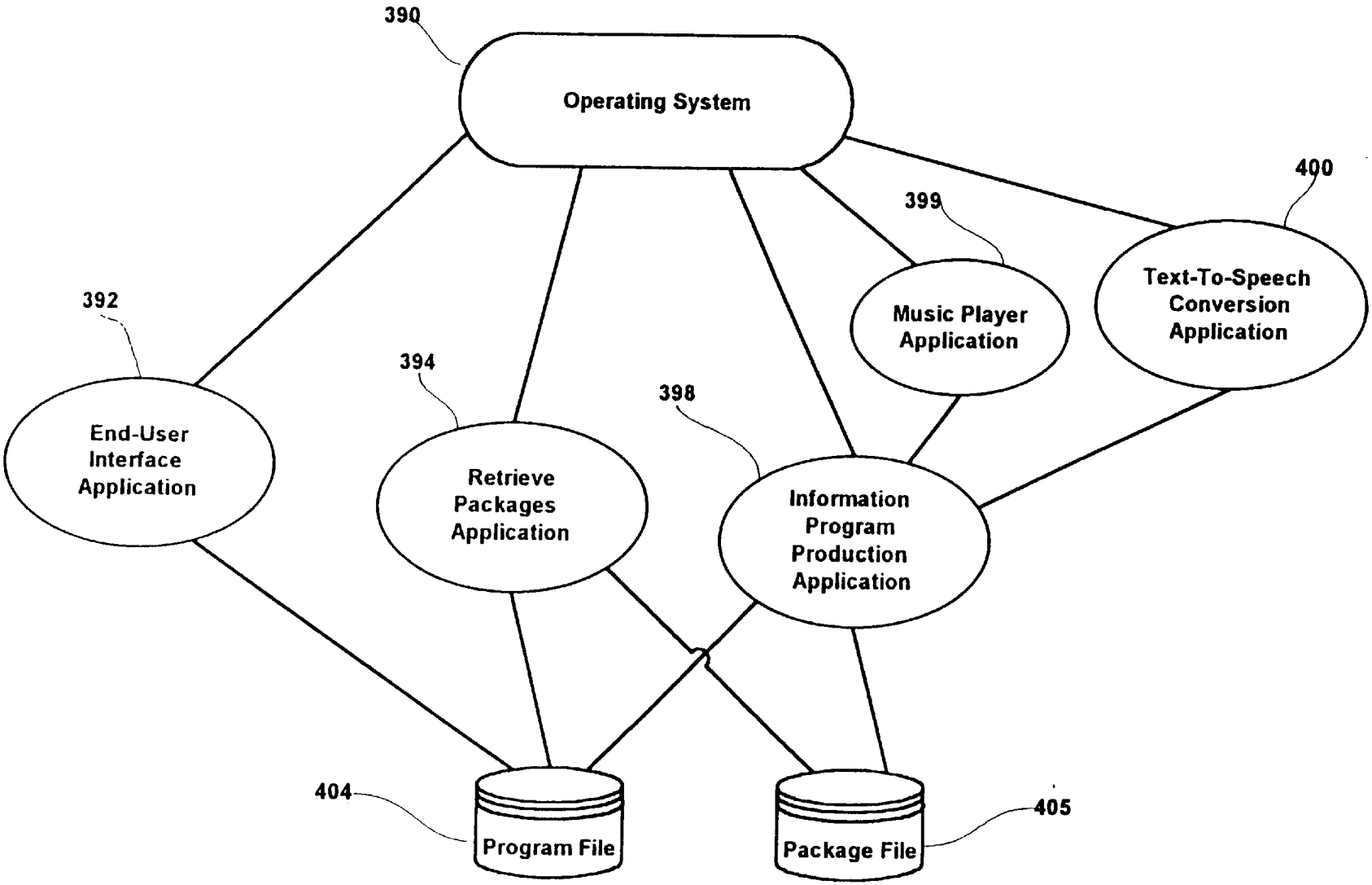
FIG. 13 is a block diagram representation of a program and data domain of the local controller of FIG. 12 in accordance with the first preferred embodiment of the present invention.

FIG. 13 displays a block diagram representation of the program and data domain of a local controller 28 in accordance with the first preferred embodiment of the apparatus of the present invention. The program domain represents programming, which is executed by the local controller's processor 346 using RAM 348, and data files, which are stored in the local controller's hard disk drive 354. Executing, on the local controller 28, in addition to and in communication with an operating system 390 are: an end-user interface application 392; a retrieve packages application 394; an information program production application 398; a music player application 399; and, a text-to-speech conversion application 400. One example of an operating system 390, acceptable in accordance with the first preferred embodiment of the apparatus of the present invention, is the Windows 3.1 operating system available from Microsoft, Corp. of Redmond, Wash. One example of a music player application 399, acceptable in accordance with the first preferred embodiment of the apparatus of the present invention, is the Media Player program provided as a standard component of the Windows 3.1 operating system.

One example of a text-to-speech conversion application 400, acceptable in accordance with the first preferred embodiment of the apparatus of the present invention, is Pro Voice for Windows version 2.1 available from the First Byte Corporation of Torrance, Calif. The end-user interface application 398 accesses a program file 404 and gathers information from an end-user of the local controller 28 with regard to how and when the retrieve packages application 394 should operate. The end-user interface application 398 also enables an end-user of the local controller 28 to control operation of the information program production application 398 in order to "play" a package (i.e., output audio signals representing one or more information items combined in a package) for the end-user. The retrieve packages application 394 accesses the program file 404 and a package file 405 and causes the local controller 28 to acquire information packages from the master controller 22, via the data transport network 26 and data links 25, 27, which are stored in the package file 405. The information program production application 398 interacts with the program and package files 404, 405 and causes text and music information items to be retrieved from the package files 405. If the information item is a textual item, the information program production application 398 causes the text-to-speech conversion application 400 to convert the textual data of the information item into speech data and then causes the sound synthesizer 370 to convert the speech data into audio signals for delivery to an end-user audio device 30 via an audio signal channel 29. If the information item is a music item, the information program production application 398 causes the music player application 399 to interact with the sound synthesizer 370 to produce audio signals, representative of the musical data of the information item, for delivery to an end-user audio device 30 via an audio signal channel 29. Note that, in accordance with the first preferred embodiment of the apparatus of the present invention: the retrieve packages application 394 and the end-user interface application 398, when executed by processor 346 employing necessary data files, function as a means for receiving an information item; the information program production application 398, text-to-speech conversion application 400, the music player application 399, and the end-user interface application 398, when executed by processor 346 employing necessary data files, and in conjunction with the sound synthesizer 370, function as an information conversion means; and, the information program production application 398 and the end-user interface application 398, when executed by processor 346 employing necessary data files, function as a means for selecting an information item Also, note that the program file 404 and package file 405 comprise a database of information.

Figure 14:
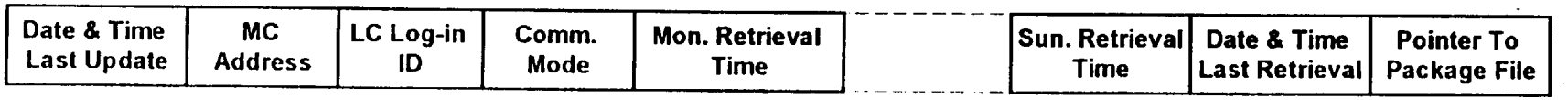
FIG. 14 is a schematic data representation of a program record stored in the program file of FIG. 13.

In accordance with the first preferred embodiment of the apparatus of the present invention, the program file 404 stores data including, setup parameters related to operation of the local controller 28, delivery schedule information which defines days and times when the local controller 28 requests package delivery from the master controller 22, and package data representing the date and time of the last package retrieval and the identity of the last package retrieved from the master controller 22. FIG. 14 displays a record structure of the program file 404. Note that the program file 404 includes only one record at any point in time. The record includes a plurality of fields including: a date and time representing the date and time when the record was last updated; a master controller address which is provided by the local controller 28 to the data transport network 26 in order to establish a communication channel, or like, with the master controller 22; a log-in identifier, containing the name and password of an end-user's local controller 28, which is used to identify an end-user's local controller 28 to the master controller 22 at the start of a communication session with the master controller 22; a communication mode parameter containing information related to how the local controller 28 is to communicate with the master controller 22 (i.e., baud rate, number of start/stop bits, parity type, etc.); a plurality of retrieval times, one per day of the week, corresponding to the time on each day when the local controller 28 is to establish a communication session with the master controller 22 to request a package delivery; a date and time representing the date and time when the last package was retrieved from the master controller 22 by the local controller 28; and, a pointer representing a unique package identifier which corresponds to one of the plurality of records in the package file.

Figure 15:
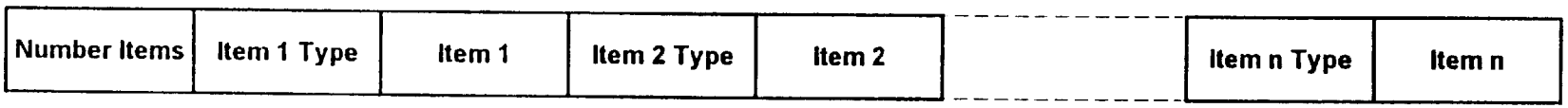
FIG. 15 is a schematic data representation of a package record stored in the package file of FIG. 13.

FIG. 15 displays a record layout of each record stored in the package file 405, in accordance with the first preferred embodiment of the present invention. The package file 405 stores one record for each package retrieved from the master controller 22 by the local controller 22 during communication sessions with the master controller 22. Note that only one package record is created per communication session, but that more than one package record may be present in the package file 405 at any point in time—the plurality of records representing the result of previous communication sessions with the master controller 22. As shown in FIG. 15, each record of the package file 405 comprises, primarily, information items and their types (i.e., textual or musical). More specifically, each record has a plurality of fields, including a number representing the number of information items present in the package record followed by one or more information items, with each information item having a type indicator which defines the item's type (i.e., textual or musical) and which precedes an associated information item FIGS. 16–21 are flow chart representations of steps, in accordance with the preferred embodiments of a method of the present invention, taken by applications of the information delivery system 10 which reside in the program domain of the master controller 22. Refer to previous figures when references are made to components previously discussed.

Figure 16:
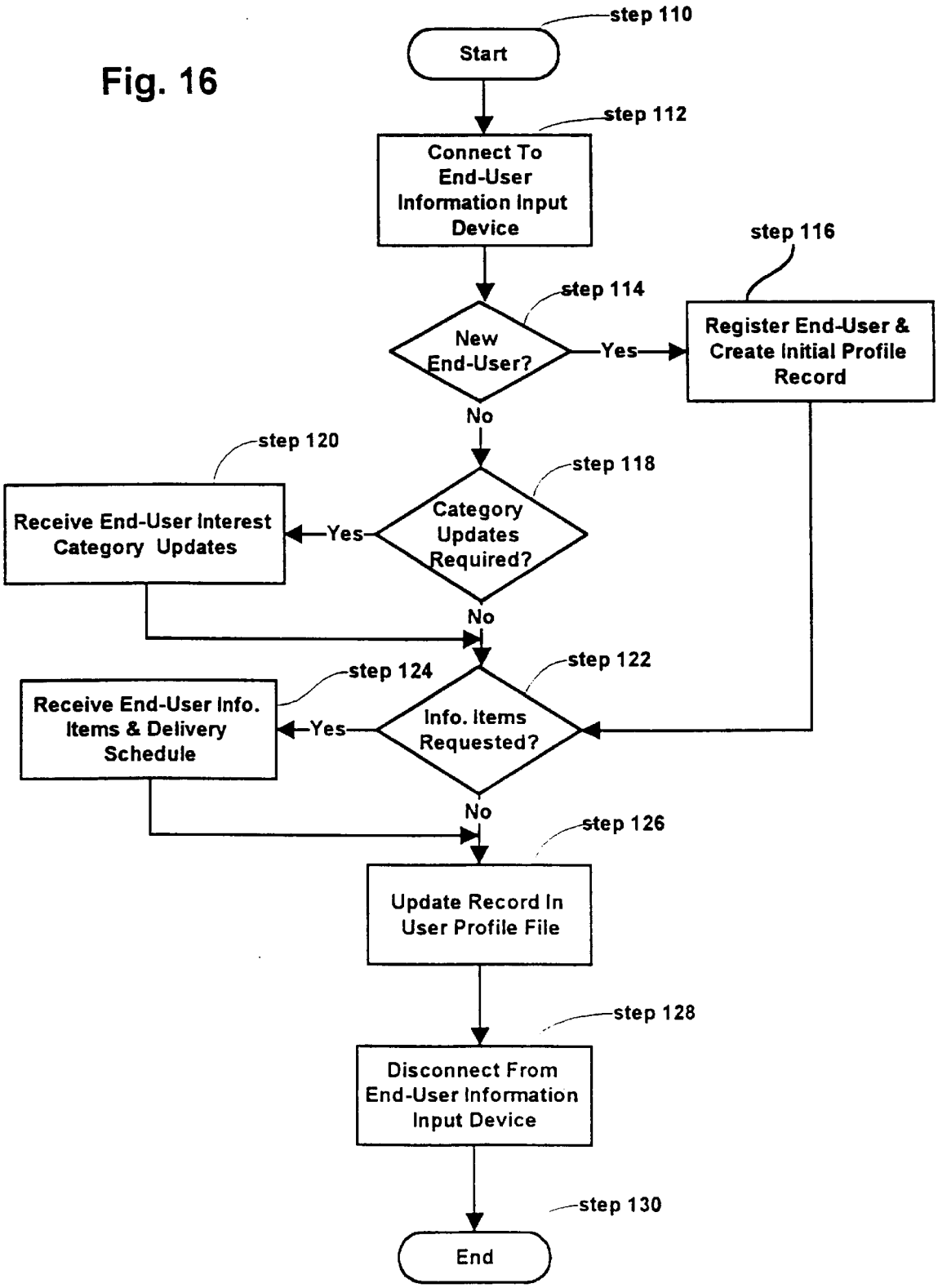
FIG. 16 is a flowchart representation of the manage end-user profile and information application in accordance with the program domain of FIG. 3.

FIG. 16 displays a flow chart representation of the steps taken by the information delivery system 10 when executing the manage end-user profile and information application 92. After starting at step 110, a communication connection is established, at step 112, between the master controller 22 and an end-user information input device 24 through data link 23. Next, at step 114, the master controller 22 determines whether or not an end-user is already registered by requesting the end-user to either input a unique identifier previously assigned to the end-user or to indicate that he/she is a new end-user. If the end-user is a new end-user, the master controller 22 registers the end-user, at step 116, by creating a new end-user profile record, assigning a unique identifier to the end-user, and asking the end-user to select information categories which are of interest to the end-user. The method then advances to step 122. If the master controller 22, at step 114, determines that the end-user is not a new end-user, the master controller 22 then determines, at step 118, whether or not the end-user wishes to change his/her categories of interest. If the end-user wishes to make changes, the master controller 22, at step 120, retrieves the existing end-user categories, of interest from the end-user's record stored in the user profile file 101, displays them for the end-user, and requests the end-user to indicate which categories are no longer of interest and to indicate which new categories are to be added to the end-user's profile. Then, at step 122, the master controller 22 determines whether or not the end-user wishes to add, delete, or modify his/her list of end-user information items, such as reminders of birthdays or special appointments, stored in the end-user's profile. If so, such additions, deletions, or modifications are received by the master controller 22 at step 124. If not, the method continues at step 126 where the master controller 22 causes all of the new and changed end-user profile data to be stored in the end-user's profile record in the user profile file 101. Then, at step 128, the master controller 22 disconnects from the end-user information input device 24. After disconnection, the method stops at step 130.

Figure 17:
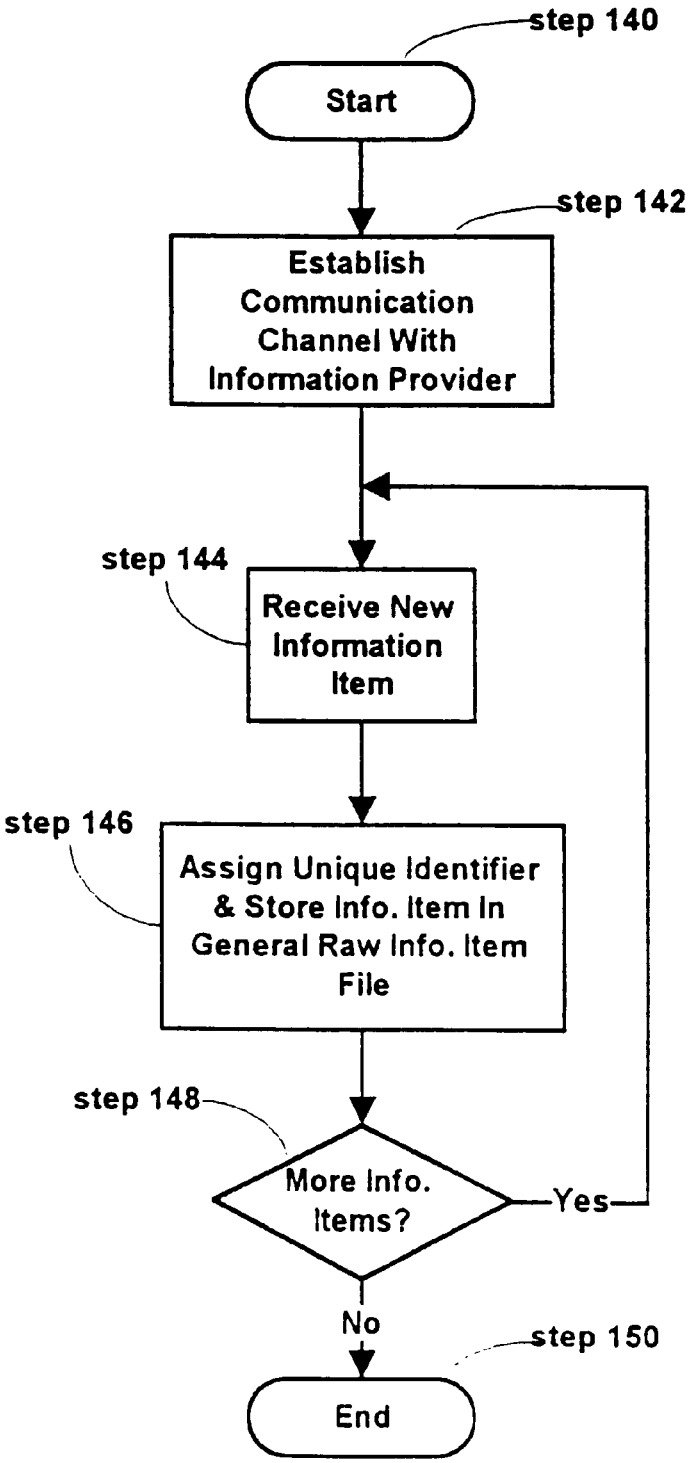
FIG. 17 is a flowchart representation of the remote information collection application in accordance with the program domain of FIG. 3.

FIG. 17 illustrates a flow chart representation of the steps taken by the information delivery system 10 when executing the remote information collection application 94. After starting at step 140, the master controller 22, at step 142, establishes a communication channel, through a data link 21, to a remote information provider 20 which supplies raw textual information to the master controller 22. At step 144, the master controller 22 receives a new information item and, at step 146, assigns a unique identifier to the information item and stores the information item in a record in the general raw information item file 102. After storing the information item, the master controller 22, at step 148, queries the remote information provider 20 to determine whether or not it has another new information item to transfer to the local controller 28. If so, the method returns to step 144 where the master controller 22 receives the new information item. If not, the method stops at step 150. Note that the remote information collection application 94 executes at periodic intervals of time and connects to a plurality of remote information providers 20 in order to collect the most recent information items from different sources.

FIG. 18 shows a flow chart representation of the steps taken by the information delivery system 10 when executing the categorize and edit application 96. After starting at step 160, the master controller 22 determines, at step 161, which type of item (i.e., a general information item or an end-user information item) upon which a system adminstrator wishes to work. If the type of item selected and received at step 161 is an end-user information item, the master controller 22, at step 165, retrieves the end-user information item, from the user profile file 101, into its random access memory 48. Then, the method advances to step 170 described below. If the type of item is a general information item, the master controller 22, at step 162, retrieves a general information item from the general raw information item file 102 into the random access memory 48. At step 163, the text of the information item is scanned by the master controller 22 to produce a list of keywords representative of potential categories of interest for the item. The list of keywords, together with the item's text, is displayed to the system administrator by the master controllers monitor 56. Upon receiving one or more selected categories, appropriate for the item, from the system administrator, the master controller 22 assigns the categories to the general information item. At step 167, the categories appropriate for the item are stored by the master controller 22 in a record in the category file 103. Next, at step 164, the master controller 22 assists the system administrator in scanning the item for references to photographs, figures, and illustrations which should be eliminated from the item in order to prevent such references from ultimately being spoken to an end-user. The master controller 22 determines, at step 166, whether or not any such references have been found. If so, the general information item together with each reference is presented by the master controller 22 to the system administrator for removal or editing at step 168. If not, the method advances to step 170 where the master controller 22 scans the information item for words requiring modification to a phonetic form so they will be pronounced correctly by the text-to-speech conversion application 400 of a local controller 28. At step 172, the master controller 22 determines whether or not such words have been discovered by the master controller 22. If so, the method moves to step 174 where replacement of such words with a phonetic equivalent is performed by the master controller 22. The method then continues at step 176. If no such words have been discovered, the method advances to step 176 where the information item is scanned by the master controller 22 to identify run-on sentences which may not sound well when spoken, by a text-to-speech conversion application 400, because there are too few punctuation marks and, therefore, an insufficient number of pauses. Then, the master controller 22 determines, at step 178, whether or not any run-on sentences were discovered in step 176. If so, the method proceeds to step 180 where the information item, including each run-on sentence, is displayed to the system adminstrator on the master controller's monitor 56 so that changes, if any, can be made to the information item, with the assistance of the master controller 22, to remove or correct a run-on sentence. Upon completion of any modifications, the method advances to step 182. If the master controller 22, at step 176, determines that no run-on sentences are present in the general information item, the method continues at step 182 where the edited information item is stored by the master controller 22 in a record in the edited information item file 104. Then, at step 184, the master controller 22 determines whether or not the information item residing in the random access memory 48 (and stored in the edited information item file 104) is a general information item or an end-user information item. If the information item is a general information item, the master controller 22, at step 186, updates the date and time field, in the item's general raw information item file record, representing the date and time when the raw information item was edited to indicate that the item was edited and stored in the edited information item file 104. The method then continues to step 190 where it stops. If the information item, as determined at step 184, is an end-user information item, the method advances to step 188 where the master controller 22 updates the date and time last updated field, in the user profile file 101, to indicate the current date and time. Then, at step 190, the method stops.

Figure 19:
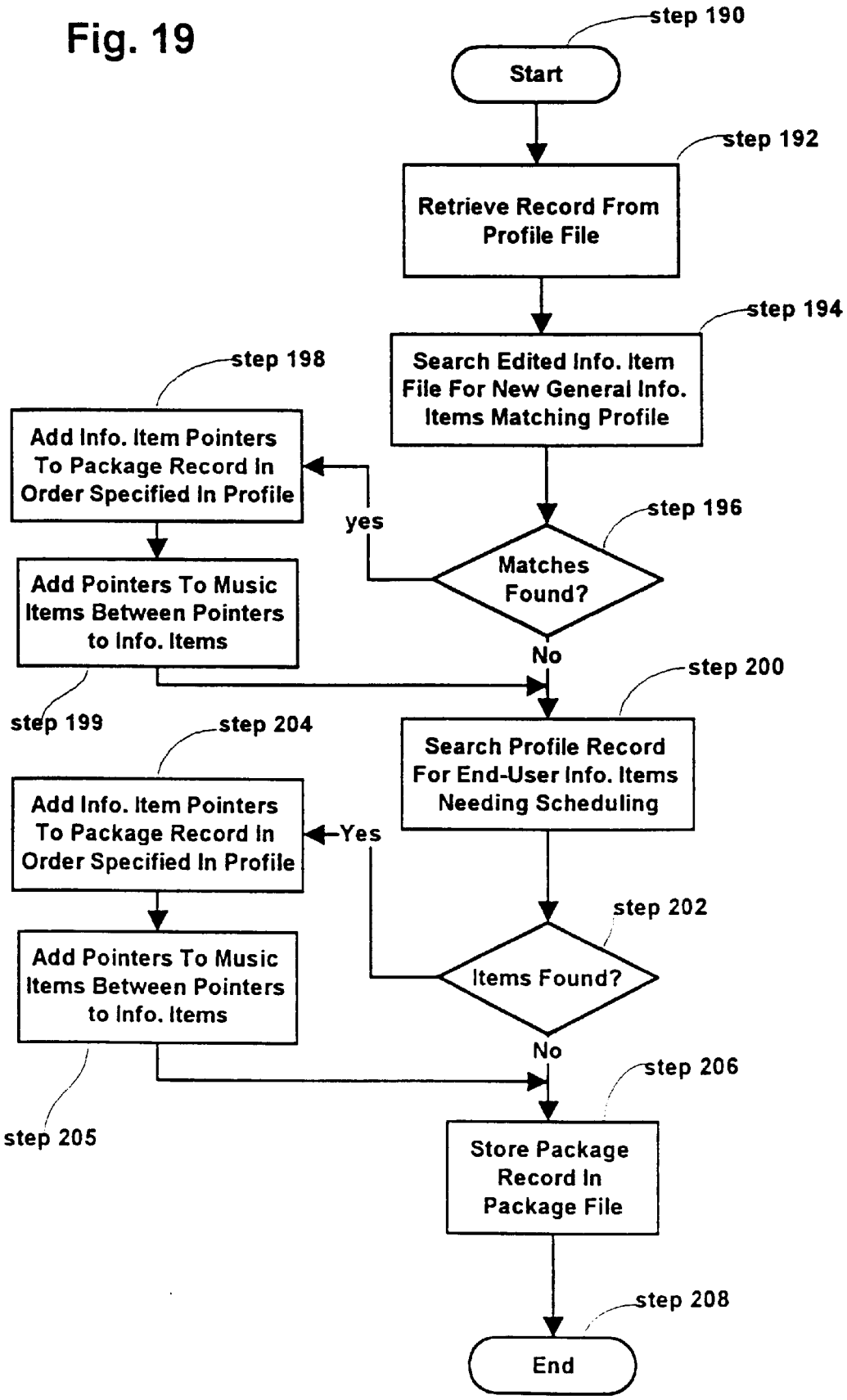
FIG. 19 is a flowchart representation of the assemble packages application in accordance with the program domain of FIG. 3.

FIG. 19 displays a flow chart representation of the steps taken by the information delivery system 10 when executing the assemble packages application 98. After starting at step 190, the method advances to step 192 where the master controller 22 retrieves the profile record of an end-user from the user profile file 101. Then, at step 194, the master controller 22 directs searching of the category file 103 to locate new general information items with an assigned category which matches one of the categories of desired information stored for the end-user in the end-user's profile record in the user profile file 101. At step 196, the master controller 22 determines whether or not any matches have been found. If not, the method advances to step 200. If so, the master controller 22, at step 198, adds one pointer per found item to a package record being formulated by the application 98. Note that pointers are ordered in the package record according to the order of the categories in the end-user profile record so that the items are ultimately spoken in the order preferred by the end-user. Then, at step 199, the master controller 22 adds pointers to music items, stored in the music directory 108, between the pointers to information items so that musical interludes are included when the package is played by an end-user audio device 30. At step 200, the master controller 22 searches the profile record to identify end-user information items which should be included in the package, as indicated by the schedule fields. The master controller 22, at step 202, determines whether or not any end-user information items are to be included in the package record. If not, the method continues at step 206. If so, the master controller 22, at step 204, adds a pointer to the package record for each end-user information item which is to be included in the package. At step 205, pointers to music items, stored in the music directory 108, are inserted by the master controller 22 between the pointers for end-user information items in the package record. Then, at step 206, the master controller 22 stores the formulated package record in the package file 105. The method stops at step 208.

Figure 20:
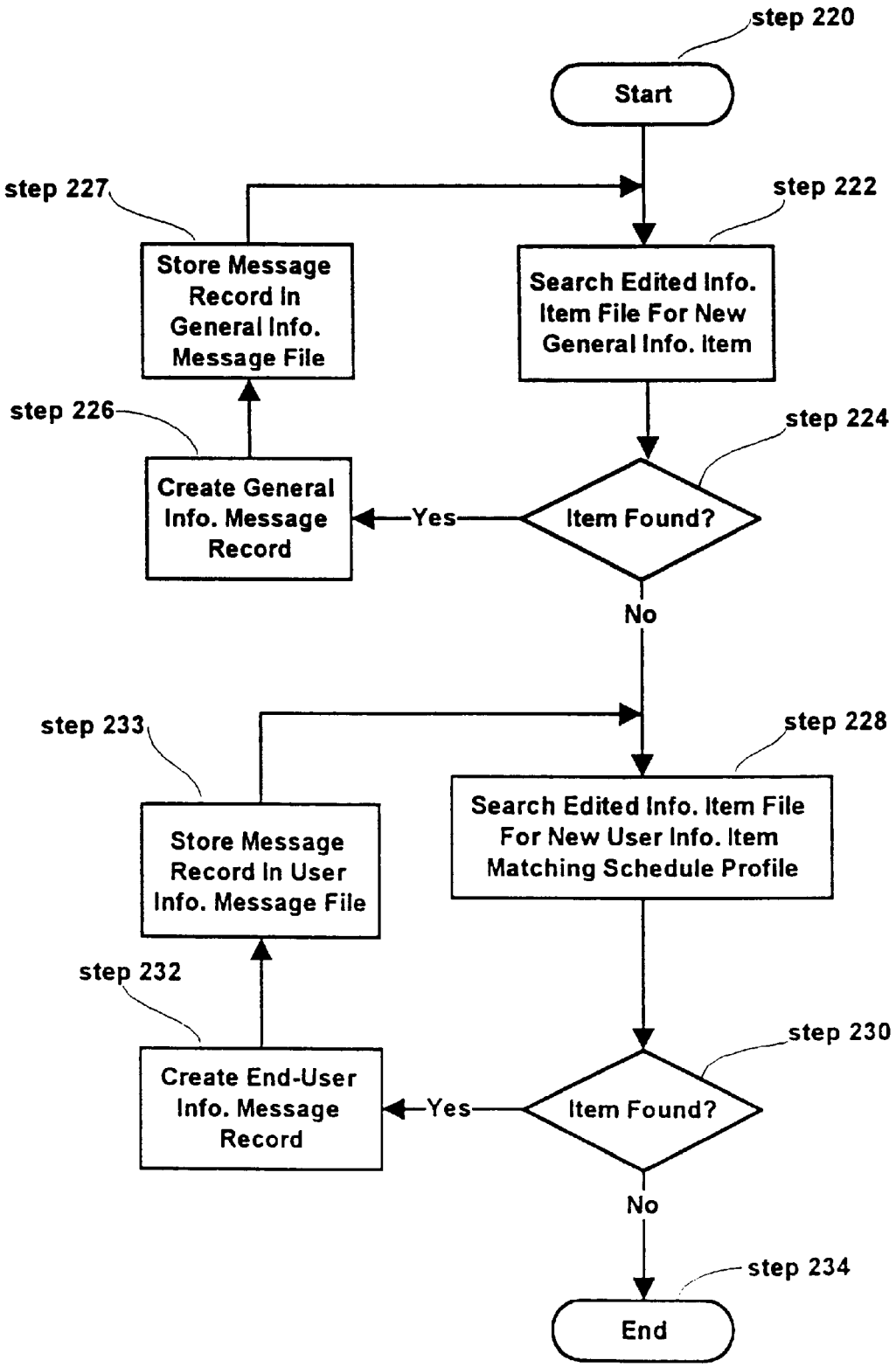
FIG. 20 is a flowchart representation of the assemble messages application in accordance with the program domain of FIG. 3.

FIG. 20 displays a flow chart representation of the steps taken by the information delivery system 10 when executing the assemble messages application 99. After starting at step 220, the method advances to step 222 where the edited information items file 104 is searched by the master controller 22 for information items which have not yet been formatted as messages. The master controller 22, at step 224, determines whether or not any such information items exist. If not, the method advances to step 228. If so, the master controller 22 directs creation of a record, at step 226, for the general information message file including a unique message identifier, a pointer to the information item, and the categories assigned to the item. Then, at step 227, the record is stored by the master controller 22 in the general information message file 106. At step 228, the master controller 22 searches the edited information item file 104 for end-user information items matching the delivery schedule in the item's schedule field in the user profile file 101. The master controller 22, at step 230, determines whether or not any such information items are present. If not, the method stops at step 234. If so, the master controller 22 creates a record, at step 232, for the user information message file including an identifier for the end-user and pointers to all of the end-user information items found in step 230. After creation of the end-user information record, the master controller 22, at step 233, stores the record in the user information message file 107. The method then loops back to step 228.

Figure 21:
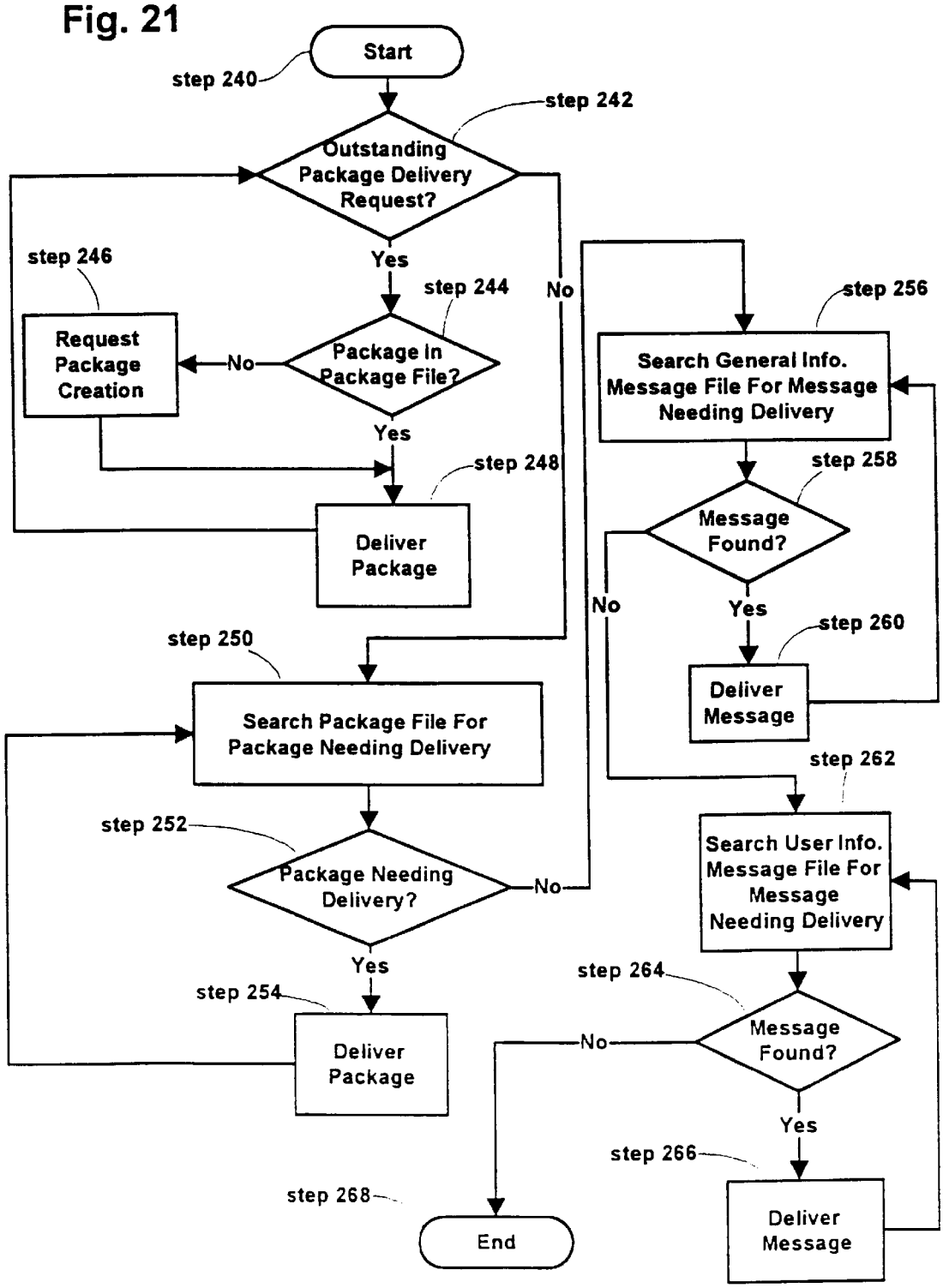
FIG. 21 is a flowchart representation of the manage end-user information delivery application in accordance with the program domain of FIG. 3.

FIG. 21 depicts a flow chart representation of the steps taken by the information delivery system 10 when executing the manage end-user information delivery application 100. After starting at step 240, the method moves to step 242 where the master controller 22 determines whether or not there is an outstanding request by one of the local controllers 28 for delivery of an end-user's package. If not, the method continues at step 250. If so, the master controller 22, at step 244, determines whether or not a package has already been created for the end-user and is waiting in the package file 105 for delivery. If so, the master controller 22, at step 248, delivers the package. If a package has not been created for the end-user, the manage end-user information delivery application 100 requests, at step 246, the assemble packages application 98 to do so. At step 248, the master controller 22 delivers the package to the requesting local controller 28 via the data transport network 26 and loops back to step 242. If no outstanding requests exist as determined in step 242, the master controller 22 searches the package file 105, at step 250, for packages which have been created and should be delivered according to the schedule specified in the end-user profile used to create the package. At step 252, the master controller 22 determines whether or not any packages are awaiting delivery. If not, the method advances to step 256. If so, the master controller 22, at step 254, delivers the package to an appropriate local controller 28 and then loops back to step 250. At step 256, the master controller 22 searches the general information message file for messages needing delivery. The master controller 22, at step 258, determines whether or not any such messages exist. If not, the method jumps to step 262. If so, the master controller 22, at step 260, delivers any such message to an appropriate local controller 28 and then loops back to step 256. At step 262, the master controller 22 searches the user information message file 107 for messages needing delivery. The master controller 22, at step 264, determines whether or not any such messages exist. If not, the method stops at step 268. If so, the master controller 22, at step 266, delivers any such message to an appropriate local controller 28 and then loops back to step 262.

FIGS. 22–25 are flow chart representations of steps, in accordance with the first preferred embodiment of a method of the present invention, taken by applications of the information delivery system 10 which reside in the program domain of the local controller 28. Refer to previous figures when references are made to components previously discussed.

Figure 22:
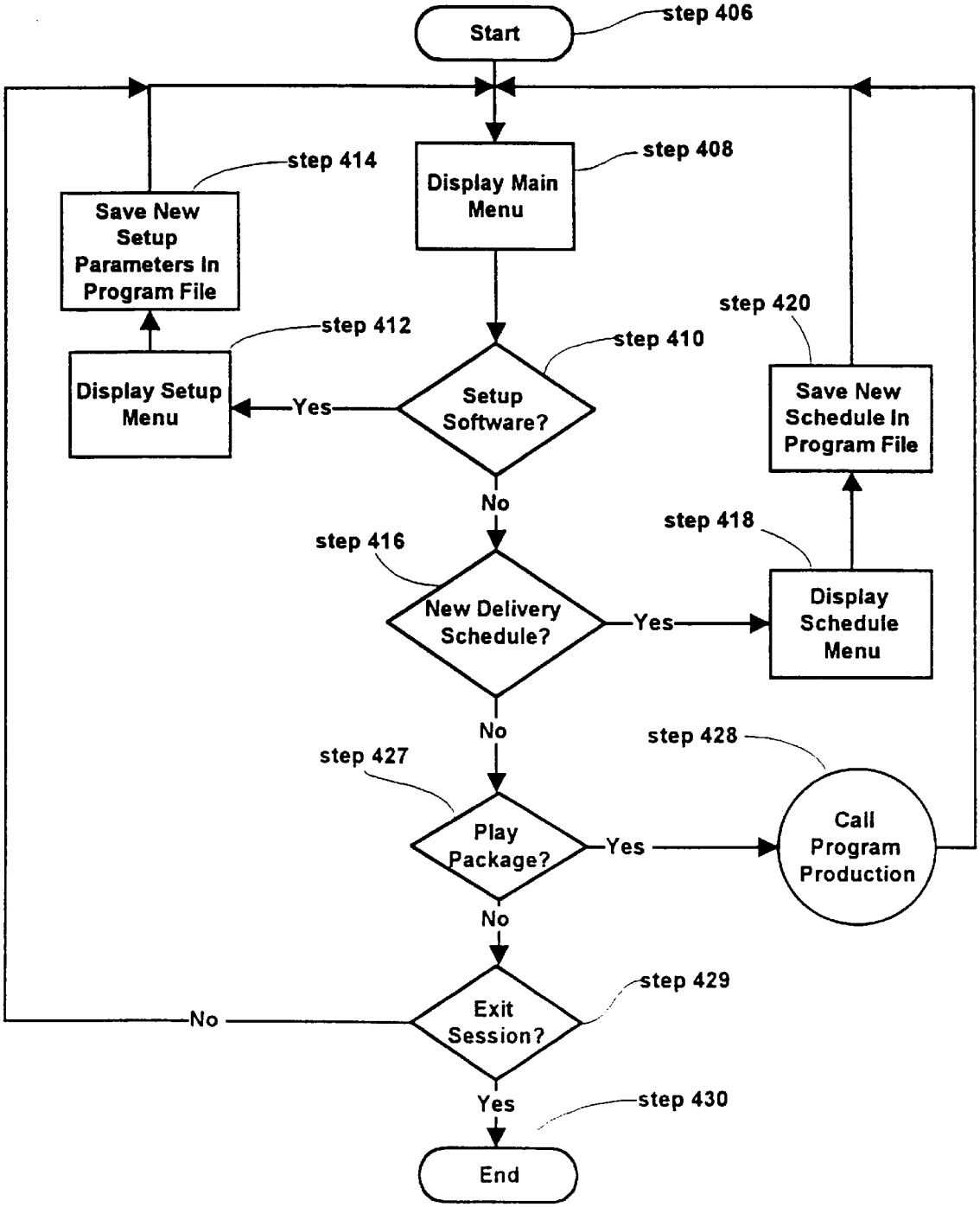
FIG. 22 is a flowchart representation of the end-user interface application in accordance with the program domain of FIG. 13.

FIG. 22 displays a flow chart representation of the steps taken by the information delivery system 10 while running the end-user interface application 392 on the local controller 22. After starting at step 406, the method advances to step 408 where the local controller 22 displays a main menu of options, from which an end-user may select, on monitor 356 and receives a selection of an option from an end-user. At step 410, the local controller 28 determines whether or not the end-user has selected an option which enables setup of the local controller 28. If not, the method continues at step 416. If so, the local controller 28, at step 412, displays a setup menu containing configuration parameters (described above with respect to FIG. 14 and including, a master controller address, a log-in identifier, and a communication mode parameter) and values from which the end-user may select. Upon receiving the end-user's inputs, the configuration parameters are stored by the local controller 28, at step 414, in the record held in the program file 404. The method then loops back to step 408. At step 416, the local controller 28 determines whether or not the end-user has selected an option which enables creation or editing of a package delivery schedule by the end-user. If not, the method moves to step 427. If so, the local controller 22, at step 418, displays a delivery schedule menu showing each day of a week and a delivery time associated with each day. After receiving the end-user's inputs and/or changes to existing delivery times, the local controller 28, at step 420, saves the delivery times to the record stored in the program file 404. The method then loops back to step 408 and the local controller 28 displays the main menu. At step 427, the local controller 28 determines whether or not the end-user has selected an option associated with playing a package. If not, the method moves to step 429. If so, the local controller 28, at step 428, executes the information program production application 398 (described in detail below) as a subroutine in order to play a package. Once the package is played for the end-user, the information program production application 398 terminates execution and returns control of the local controller 28 to the end-user interface application 392 at step 408, where the main menu is displayed to the end-user. At step 429, the local controller 28 determines whether or not the end-user has selected an option associated with exiting the application. If not, the local controller 28 displays the main menu at step 408. If so, the method stops at step 430.

Figure 23:
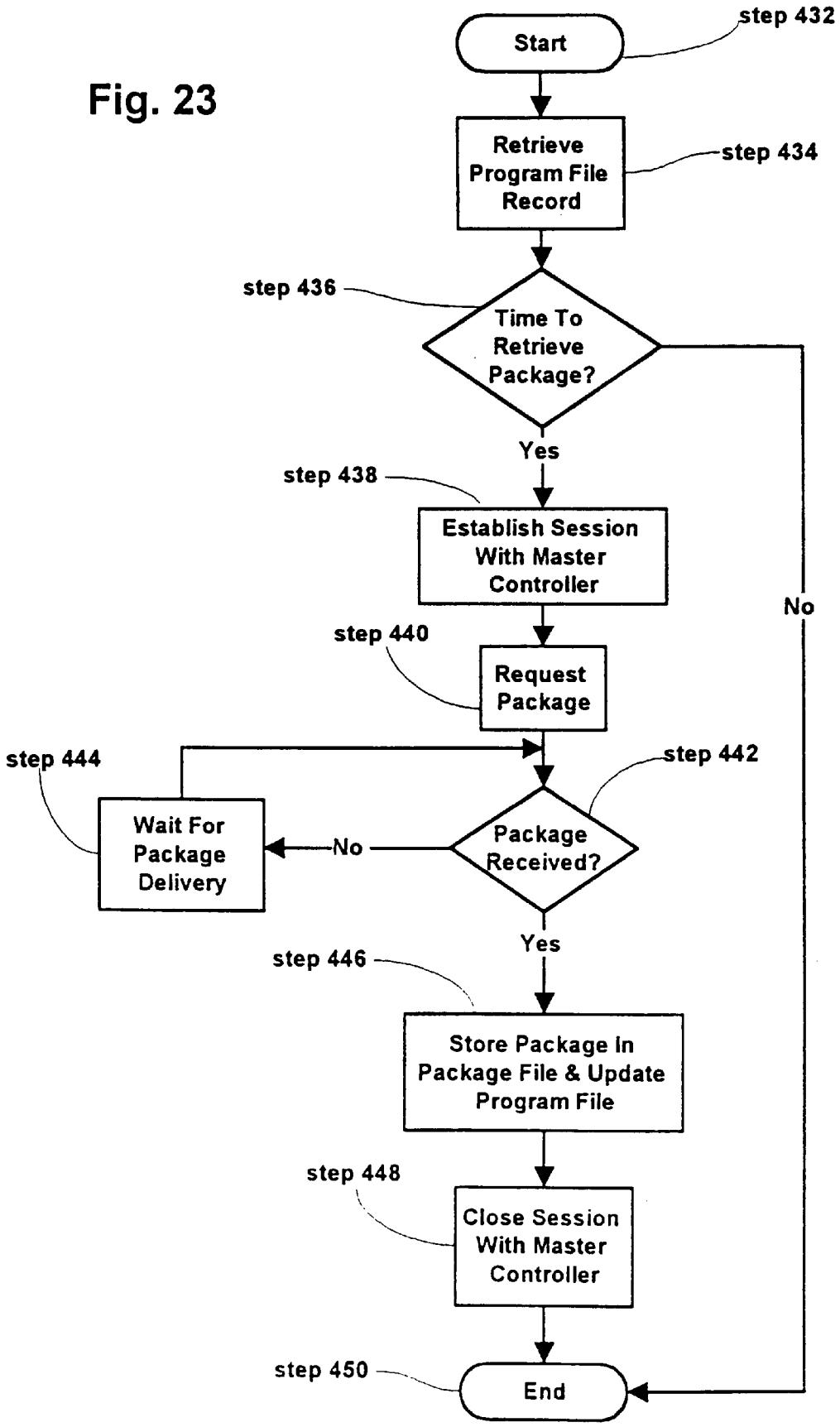
FIG. 23 is a flowchart representation of the retrieve packages application in accordance with the program domain of FIG. 13.

FIG. 23 illustrates a flow chart representation of the steps taken by the information delivery system 10 during execution of the retrieve packages application 394 on the local controller 28. After starting at step 432, the method moves to step 434 where the local controller 28 loads the program file record from the program file 404 into random access memory 348. Then, at step 436, the local controller 28 examines the retrieval days and times to determine whether or not it should attempt retrieval of a package from the master controller 22. If not, the method stops at step 450. If so, the local controller 28 establishes a communication session with the master controller 22 using the setup parameters contained in the program file record which was previously loaded from the program file 404. Once a communication session is established, the local controller 28, at step 440, issues a request to the master controller 22 for delivery of a package. At step 442, the local controller 28 determines whether or not a package has been received by the local controller 28. If not, the local controller 28 waits, at step 444, and then again determines, at step 442, whether or not a package has been received. If so, the method advances to step 446 where the local controller 28 stores the package in the package file 405 and updates the program file record to set the date and time when the last package was received and to set the pointer identifying the received package from other packages stored in the package file 405. Then, at step 448, the local controller 28 ends the communication session with the master controller 22 and, subsequently, the method stops at step 450.

Figure 24:
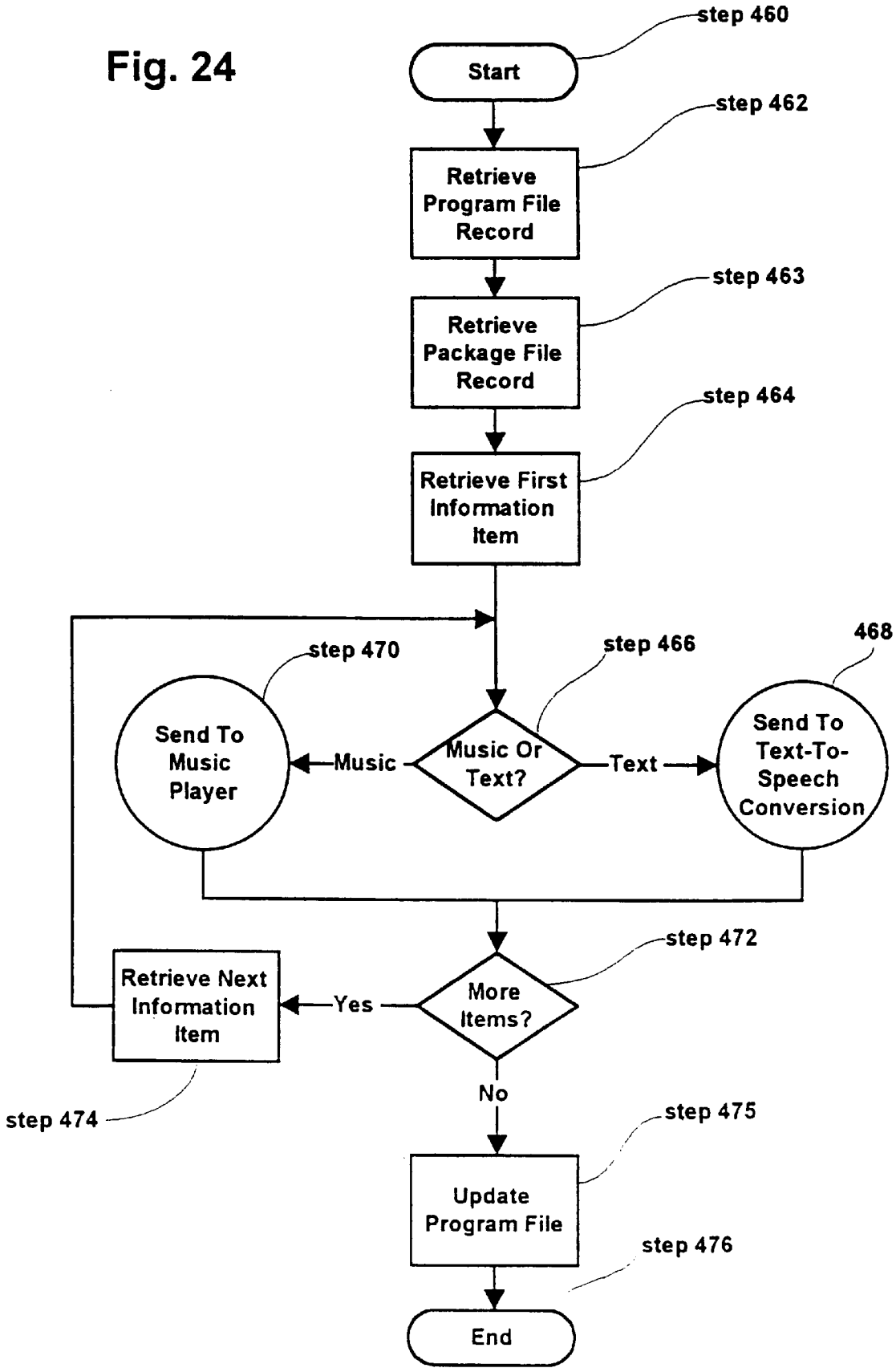
FIG. 24 is a flowchart representation of the information program production application in accordance with the program domain of FIG. 13.

FIG. 24 displays a flow chart representation of the steps taken by the information delivery system 10 in executing the information program production application 398 on the local controller 28. After starting at step 460, the method advances to step 462 where the local controller 28 retrieves the program file record from the program file 404. Then, using the pointer (which uniquely identifies the last received package) contained in the program file record, the local controller 28 at step 463, loads the package file record containing a pointer which matches the pointer stored in the program file record. Next, at step 464, the local controller 28 retrieves the first information item, including its type, from the package file record. At step 466, the local controller 28 determines whether or not the information item is a textual type item or a musical type item. If the information item is a textual type item, the local controller 28, at step 468, sends the information item to the text-to-speech conversion application 400 and executes the text-to-speech conversion application 400 as a subroutine to produce audio signals representative of the textual information item on audio signal channel 29 for receipt by a connected end-user audio device 30. Upon return from the text-to-speech conversion application 400, the method advances to step 472. If the local controller 28, at step 466, determines that the information item is a musical type item, the method moves to step 470 where the information item is sent to the music player application 399 for production of audio signals representative of the musical information item on audio signal channel 29 for receipt by a connected end-user audio device 30. After completion of the synthesizing process, the method then continues at step 472 where a determination is made as to whether or not more information items are included in the package file record. If so, the local controller 28 retrieves the next information item from the package file record at step 474 and the method loops back to step 466 where the local controller 28 determines the type of information item retrieved and, subsequently, produces audio signals for receipt by an end-user audio device 30. If not, the local controller 28, at step 475, updates the date and time of the last retrieval of the program file record and, thereby to indicate that the program was played. Then, the method stops at step 476.

Figure 25:
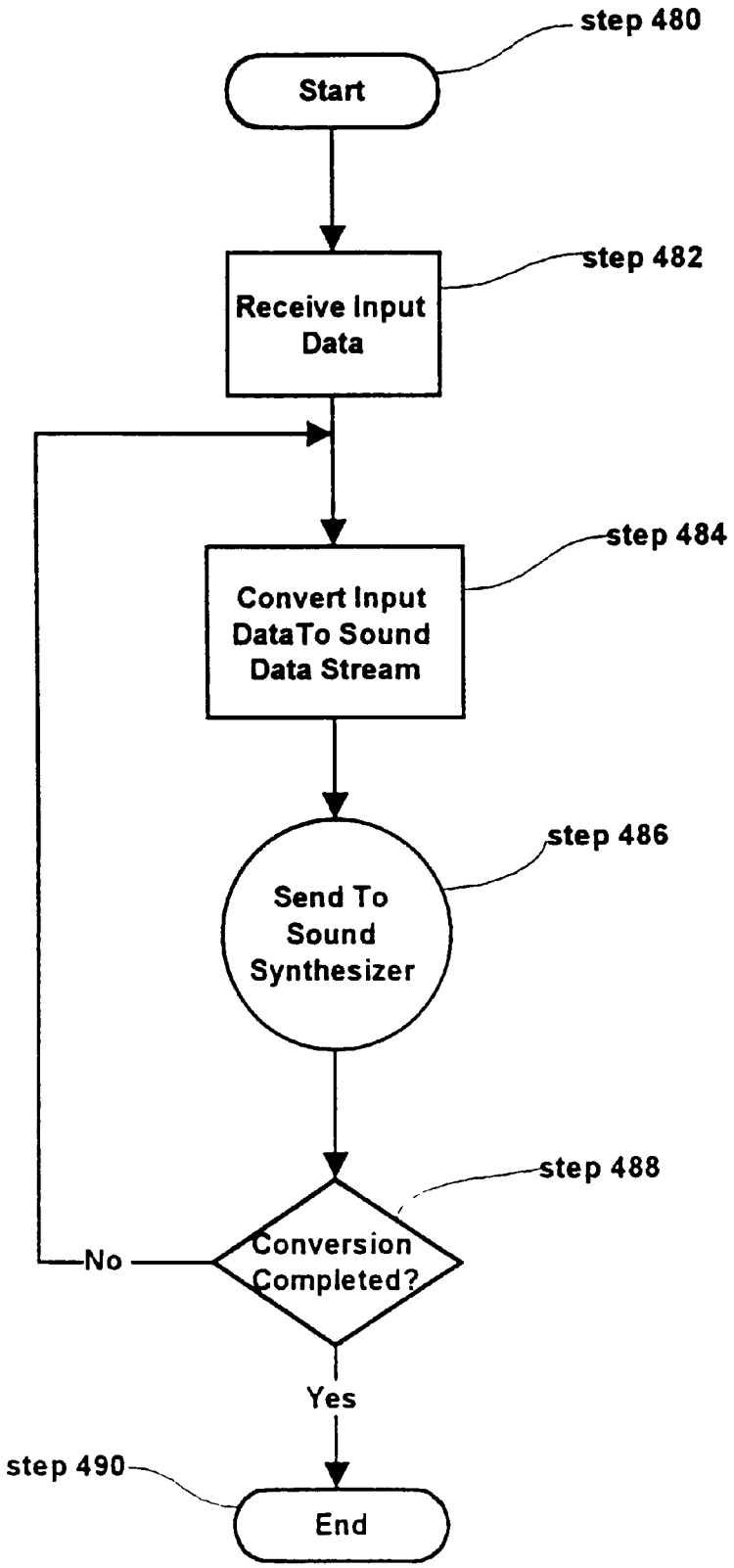
FIG. 25 is a flowchart representation of the text-to-speech conversion application in accordance with the program domain of FIG. 13.

FIG. 25 illustrates a flow chart representation of the steps taken by the information delivery system 10 while executing both the music player application 399 and the text-to-speech conversion application 400 on the local controller 28. After starting at step 480, the method advances to step 482 where a string of input data (i.e., a textual information item or a music item) is received from the information program production application 398 through interprocess communications which are well understood to those reasonably skilled in the art. Then, at step 484, the local controller 28 causes the input data to be converted into a stream of sound data which is sent, at step 486, by the local controller 28 to the sound synthesizer 370 for conversion into audio signals which are transferred to an end-user audio device 30. Next, at step 488, the local controller 28 determines whether or not the conversion process is complete. If so, the method stops at step 490. If not, the local controller 28, at step 484, continues converting text data into speech data.

Figure 26:
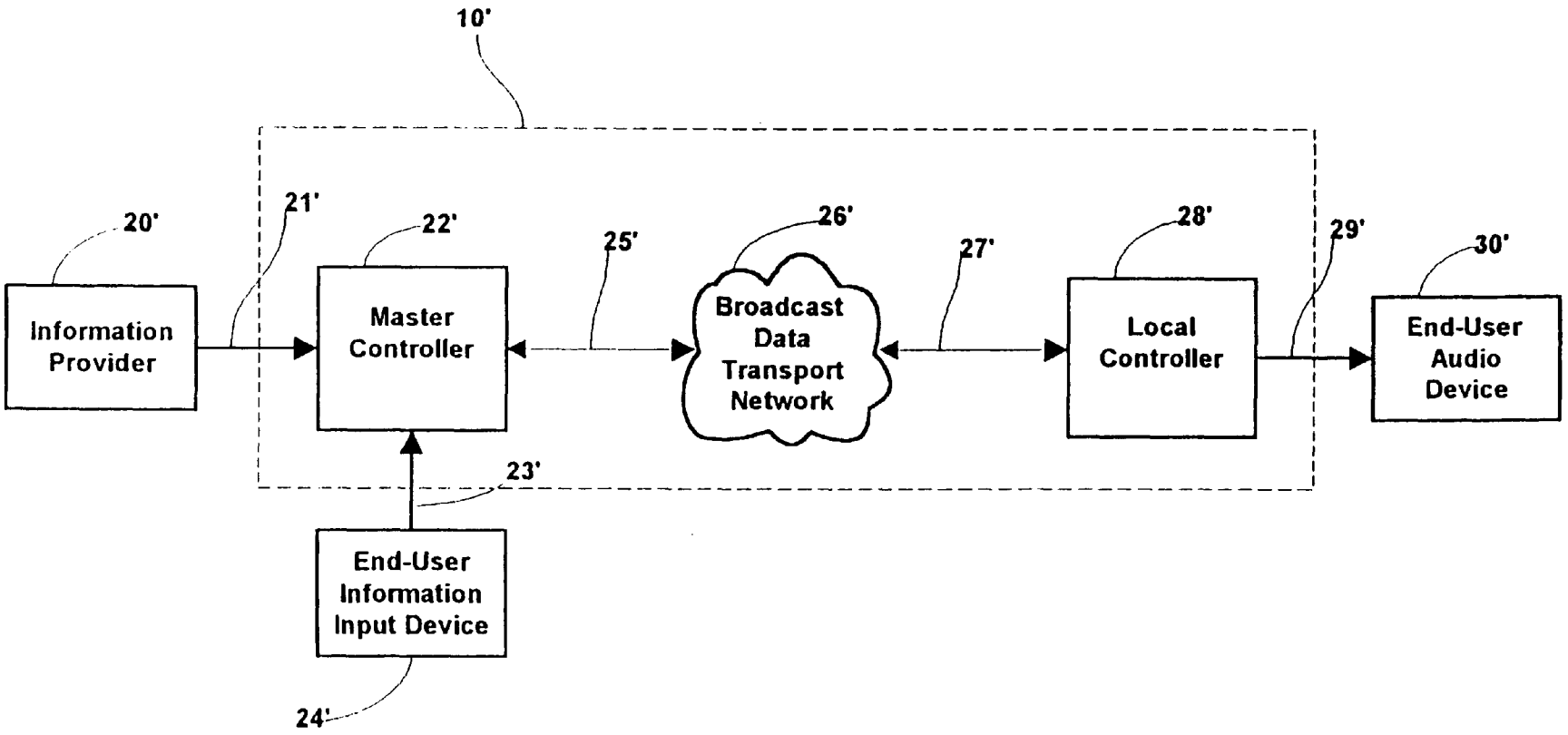
FIG. 26 is a block diagram representation of an audio information delivery system in accordance with a second preferred embodiment of the present invention.
Figure 27:
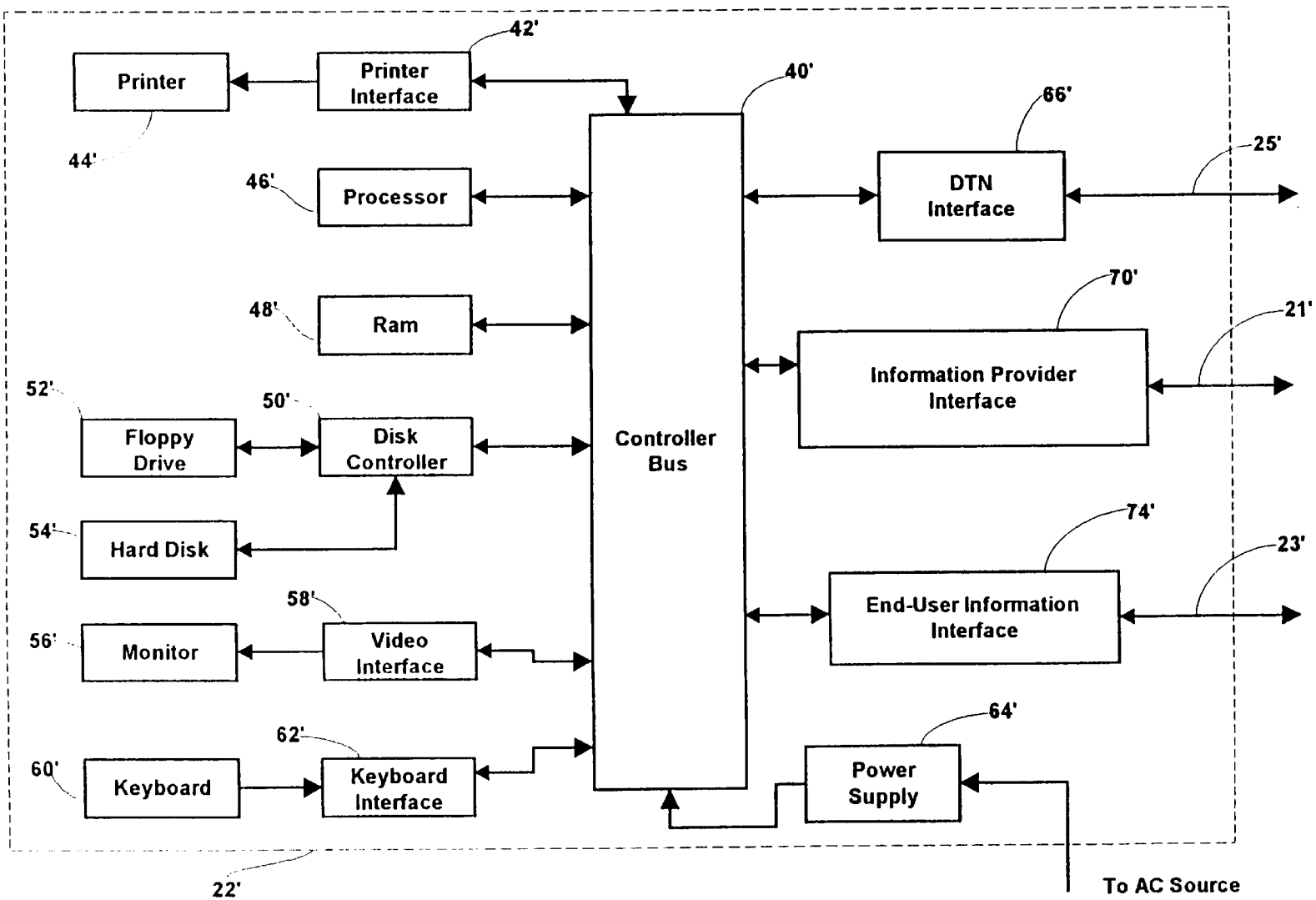
FIG. 27 is a block diagram representation of the master controller of FIG. 26.
Figure 28:
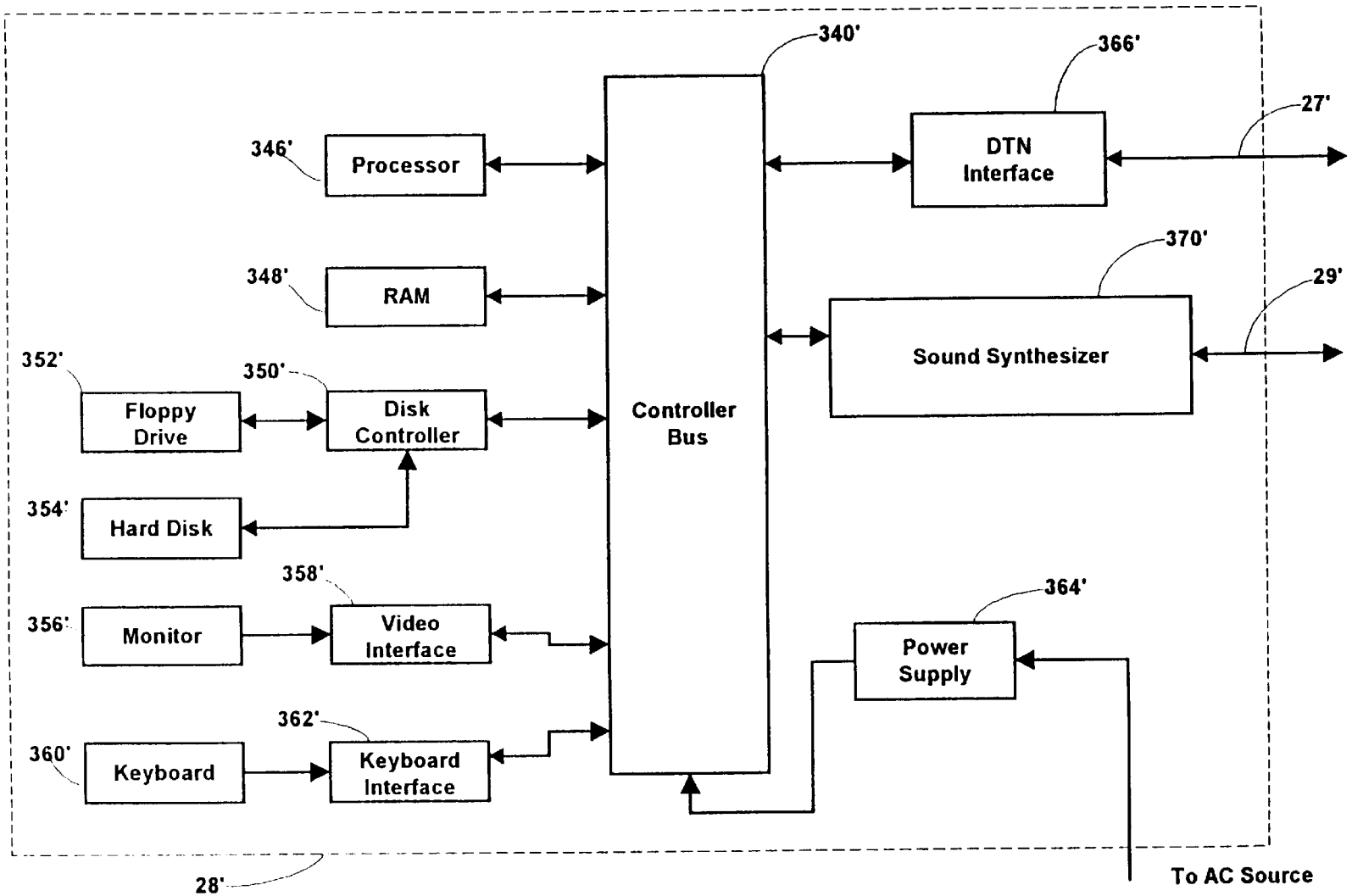
FIG. 28 is a block diagram representation of the local controller of FIG. 26.

In accordance with a second preferred embodiment of the apparatus of the present invention shown in FIG. 26, the information delivery system 10' comprises a master controller 22', including a program and data domain, which is substantially similar to the master controller 22 of the first preferred embodiment. The master controller 22' connects to a plurality of information providers 20' and to a plurality of end-user information input devices 24' similar to those of the first preferred embodiment. Note that while only one information provider 20' and only one end-user information input device 24' are shown in FIG. 26, it is understood that the displayed information provider 20' and the displayed end-user information input device 24' represent a plurality of information providers 20' and a plurality of end-user information input devices 24', respectively. Also, note that data links 21', 23' represent pluralities of data links 21', 23', each data link 21' connecting an information provider 20' to the master controller 22' and each data link 23' connecting an end-user information input device 24' to the master controller 22'. The master controller 22' communicates with a local controller 28' via a wireless, broadcast data transport network 26' which interfaces to the master controller 22' through an appropriate broadcast data network interface 66' (see FIG. 27). The local controller 28' shown in FIG. 26 represents a plurality of local controllers 28', each having an appropriate broadcast data network interface 366' (see FIG. 28) which connects a local controller 28' to the broadcast data transport network 26'. An example of an acceptable local controller 28', in accordance with the second preferred embodiment of the apparatus of the present invention, is a Model 755c laptop personal computer available from IBM, Corp. of Armonk, N.Y. configured with a Model Info TAC external wireless data modem (available from Motorola, Inc. of Schaumberg, Ill.) functioning as a broadcast data network interface 366'. The Model 755c laptop personal computer includes a built-in sound synthesizer 370'. It is understood that other devices configured to function as local controllers 28' are considered within the scope of the apparatus of the present invention. It is also understood that the end-user audio device 30' connected to the local controller 28', as seen in FIG. 26, represents a plurality of end-user audio devices 30' which may be connected to the local controller 28' via an audio signal channel 29'.

Figure 29:
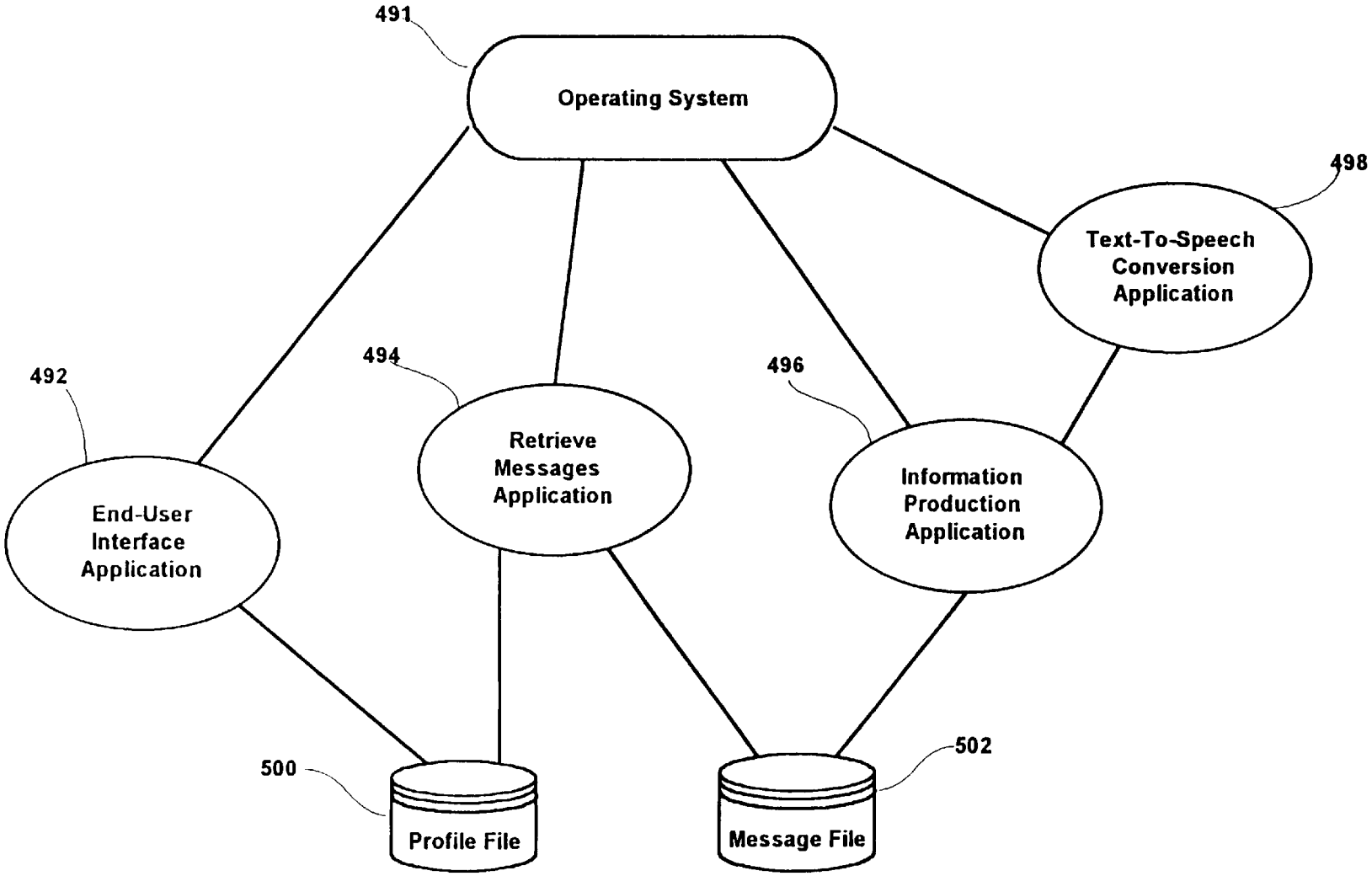
FIG. 29 is a block diagram representation of a program and data domain of the local controller of FIG. 28 in accordance with the second preferred embodiment of the present invention.

FIG. 29 displays a block diagram representation of a program and data domain of a local controller 28' in accordance with the second preferred embodiment of the apparatus of the present invention. The program domain represents programming, which is executed by the local controller's processor 346' using RAM 348', and data files, which are stored in the local controller's hard disk drive 354'. Executing, on the local controller 28', in addition to and in communication with an operating system 491 are: an end-user interface application 492; a retrieve messages application 494; an information production application 496; and, a text-to-speech conversion application 498. One example of an operating system 491, acceptable in accordance with the second preferred embodiment of the apparatus of the present invention, is the Windows 3.1 operating system available from Microsoft, Corp. of Redmond, Wash. One example of a text-to-speech conversion application 498, acceptable in accordance with the first preferred embodiment of the apparatus of the present invention, is ProVoice for Windows version V2.1 available from the First Byte Corporation of Torrance, Calif. The end-user interface application 492 gathers and stores information from an end-user, in a profile file 500, which determines how the retrieve messages application 494 operates, including identifying which messages are to be received from the master controller 22' and stored in a message file 502 by the retrieve messages application 494. The end-user interface application 492 also allows an end-user to control operation of the information production application 496, which "plays" messages for the end-user, including causing the information production application 496 to retrieve information items from the message file 502. The information production application 496 interfaces with the text-to-speech conversion application 498, causing retrieved information items to be converted into sound data which is supplied to the sound synthesizer 370' in order to produce audio signals, on audio signal channel 29', representative of the text comprising each information item. Note that the text-to-speech conversion application 498 operates in a substantially similar manner to the text-to-speech conversion application 400 of the first preferred embodiment of the method of the present invention and is, therefore, not discussed below. Note also that the profile file 500 and the message file 502 comprise a database of information.

Figure 30:
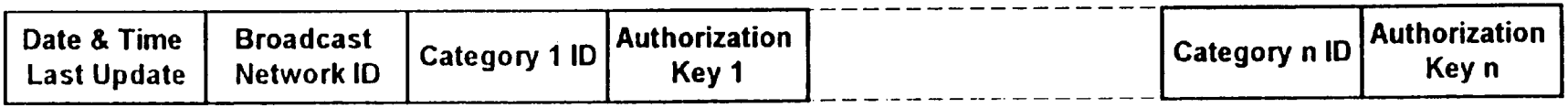
FIG. 30 is a schematic data representation of a profile record stored in the profile file of FIG. 29.

In accordance with the second preferred embodiment of the apparatus of the present invention, the profile file 500 stores data including, a setup parameter related to operation of the local controller 28' and selection information used to determine which messages are to be retrieved from the broadcast data transport network 26' by the local controller 28'. FIG. 30 displays a record structure of the profile file 500. Note that the profile file 500 includes only one record at any point in time. The record includes a plurality of fields including: a date and time representing the date and time when the record was last updated; an identifier which identifies a broadcast data transport network 26' and a frequency to which the broadcast data network interface 366' is tuned in order to receive messages from the identified broadcast data transport network 26'; and, one or more profile choices, each having an identifier corresponding to a category of information items desired by an end-user and an authorization key which is utilized by the retrieve messages application 494 to interpret information items of the associated category.

Figure 31:
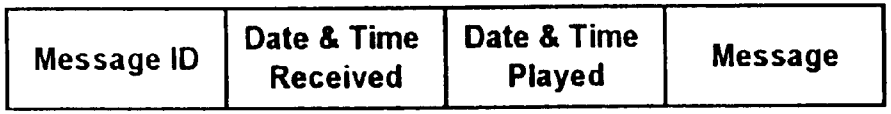
FIG. 31 is a schematic data representation of a message record stored in the message file of FIG. 29.

FIG. 31 displays a record layout of each record stored in the message file 502, in accordance with the second preferred embodiment of the present invention. The message file 502 stores one record for each message retrieved from the broadcast data transport network 26' by the local controller 22 during execution of the retrieve messages application 494. Note that one message record is created for each category of information items desired by an end-user and that more than one message record may be present in the message file 502 at any point in time. As shown in FIG. 31, each record of the message file 502 comprises a plurality of fields, including: an identifier, incorporated into each message by the master controller 22' and received by the local controller 28' via the broadcast data transport network 26', which uniquely identifies a message; a date and time representing the date and time when the associated message was received by the local controller 28'; a date and time representing the date and time when the associated message was played by the information production application 496; and, a message representing an information item and containing information in text form only.

Figure 32:
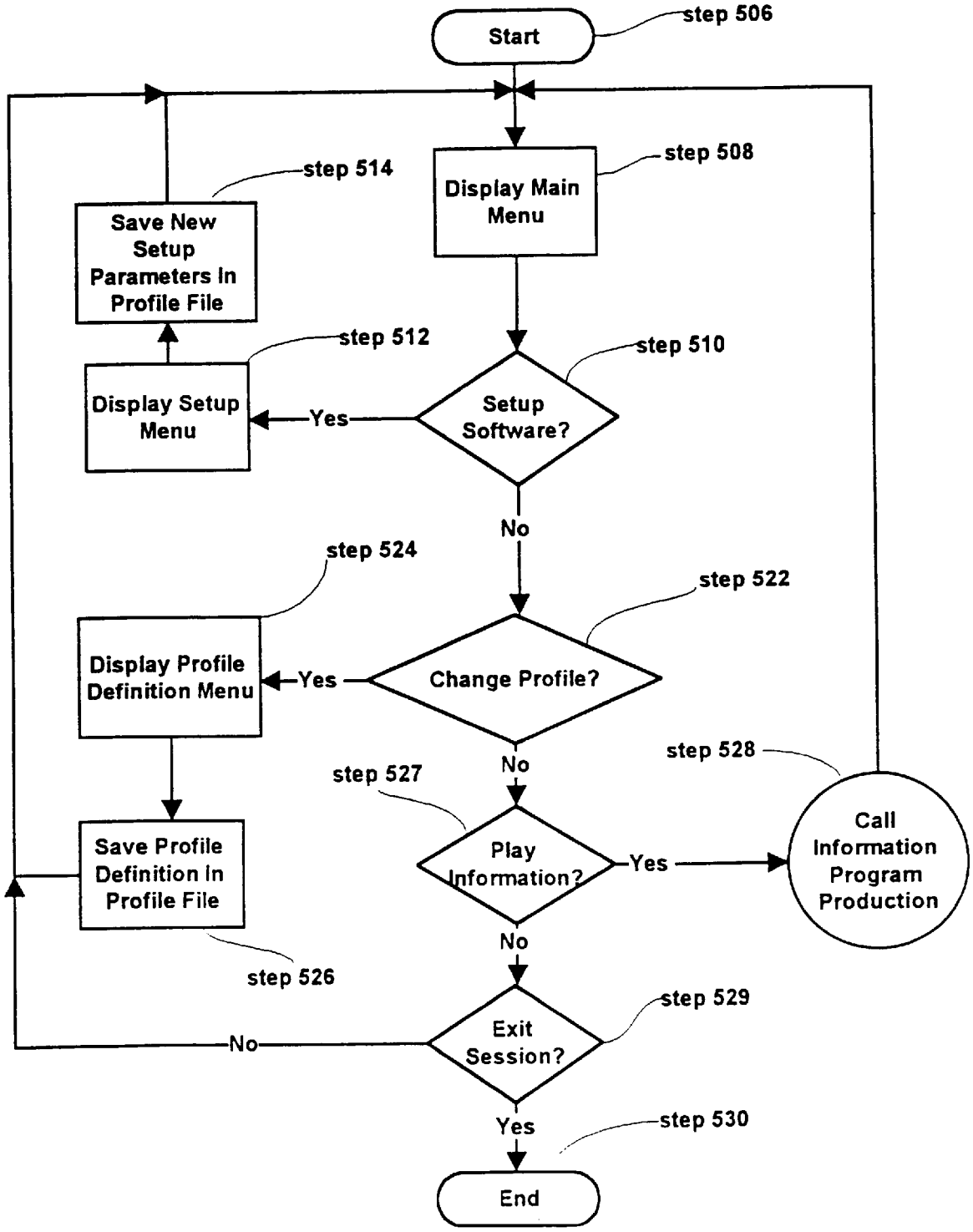
FIG. 32 is a flowchart representation of the end-user interface application in accordance with the program domain of FIG. 29.
Figure 33:
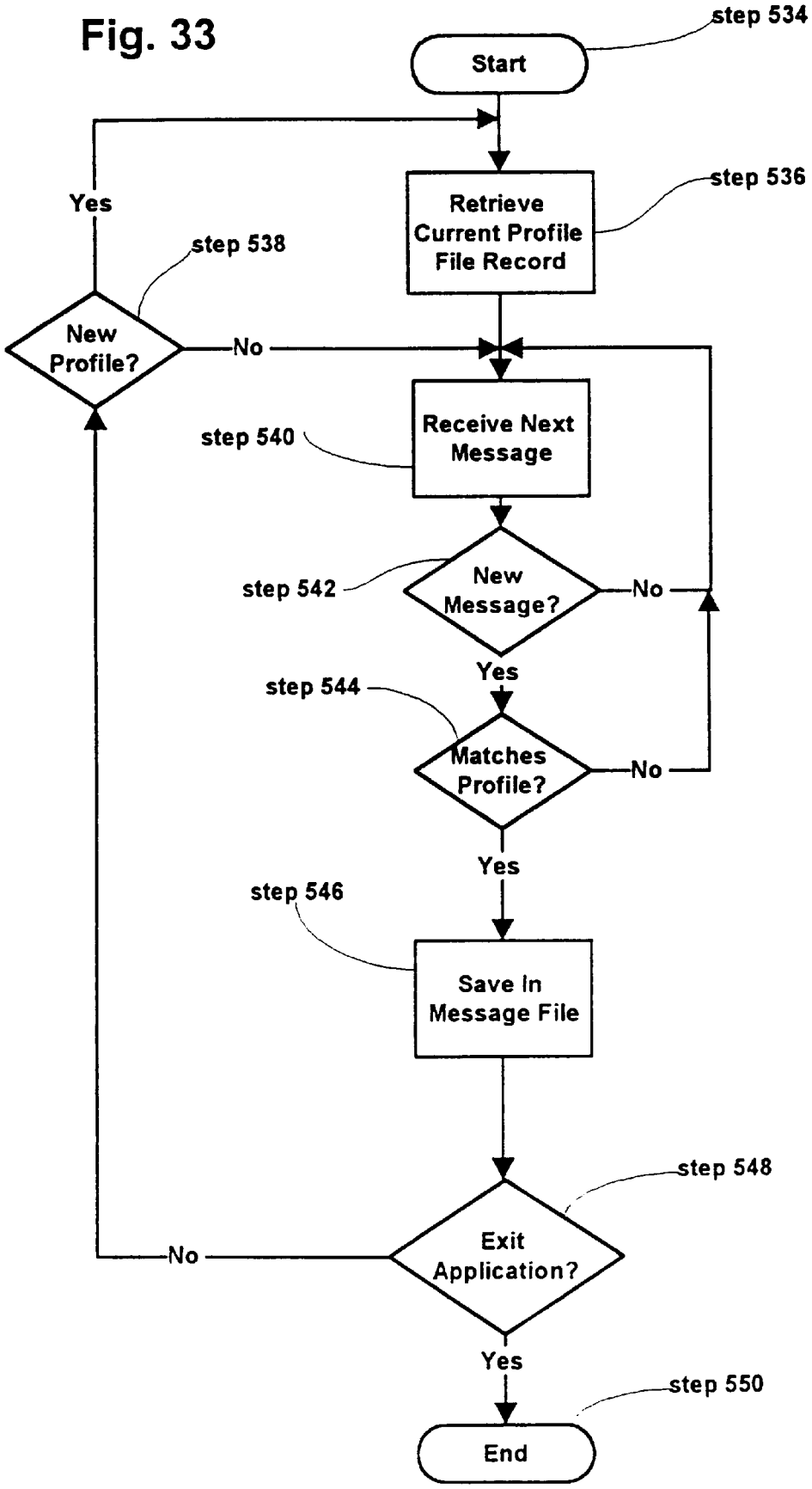
FIG. 33 is a flowchart representation of the retrieve messages application in accordance with the program domain of FIG. 29.
Figure 34:
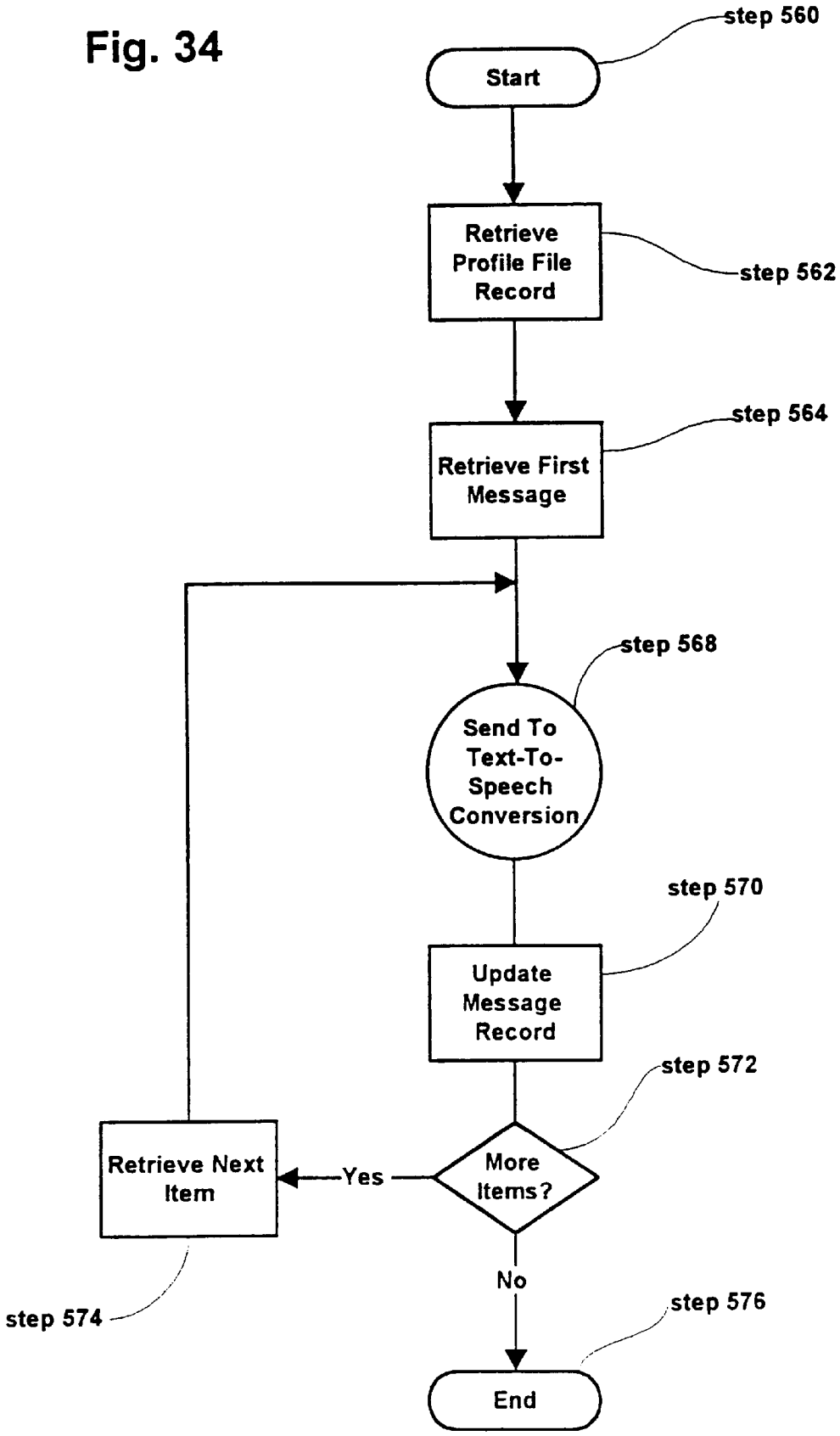
FIG. 34 is a flowchart representation of the information production application in accordance with the program domain of FIG. 34.

FIGS. 32–34 are flow chart representations of steps, in accordance with the second preferred embodiment of a method of the present invention, taken by applications of the information delivery system 10' which reside in the program and data domain of the local controller 28'. Refer to previous figures when references are made to components previously discussed.

FIG. 32 displays a flow chart representation of the steps taken by the information delivery system 10' while running the end-user interface application 492 on the local controller 28'. After starting at step 506, the method advances to step 508 where the local controller 28' displays a main menu of options on monitor 356', from which an end-user may select, and receives a selection of an option from an end-user. At step 510, the local controller 28' determines whether or not the end-user has selected an option which enables setup of the local controller 28'. If not, the method continues at step 522. If so, the local controller 28', at step 512, displays a setup menu containing a broadcast data transport network identifier (described above with respect to FIG. 30) and values of possible identifiers from which the end-user may select. Upon receiving the end-user's inputs, the broadcast data transport network identifier is stored, at step 514, in the record held in the profile file 500. The method then loops back to step 508. At step 522, the local controller 28' determines whether or not the end-user has selected an option which enables changes to the profile choices by the end-user. If not, the method moves to step 527. If so, the local controller 28', at step 524, displays a profile definition menu showing one or more categories of information items desired by the end-user and associated authorization keys. Note that only those profile choices for which the end-user enters an authorization key will be retrieved from the broadcast data transport network 26' by the local controller 28'. After receiving the end-user's inputs and/or changes to existing profile choices, the local controller 28', at step 526, saves the profile choices to the record stored in the profile file 500. The method then loops back to step 508 and where the local controller 28' displays the main menu. At step 527, the local controller 28' determines whether or not the end-user has selected an option associated with playing a message. If not, the method moves to step 529. If so, the local controller 28', at step 528, executes the information program production application 496 (described in detail below) as a subroutine in order to play a message. Once the message is played for the end-user, the information program production application 496 terminates execution and returns control of the local controller 28' to the end-user interface application 492 at step 508 where the main menu is displayed to the end-user. At step 529, the local controller 28' determines whether or not the end-user has selected an option associated with exiting the application. If not, the method loops back where the local controller 28' displays the main menu at step 508. If so, the method stops at step 530.

FIG. 33 illustrates a flow chart representation of the steps taken by the information delivery system 10' during execution of the retrieve messages application 494 on the local controller 28'. After starting at step 534, the method advances to step 536 where the local controller 28' retrieves the profile record from the profile file 500 into random access memory 348'. Then, at step 540, the local controller 28' begins receiving messages from the broadcast data transport network 26' via the broadcast data network interface 366'. Note that the local controller 28' then continues to receive messages from the broadcast data transport network 26' until the method stops at step 550. Note also that messages are broadcast several times by the master controller 22' over the broadcast data transport network 26' to increase the likelihood that an uncorrupted copy of the message will be received by each of the plurality of local controllers 28'. Upon receiving a message for the first time, as part of step 540, the local controller 28' records the unique identifier associated with the received message in random access memory 348'. At step 542, the local controller 28' determines whether or not the received message is a new message (i.e., the local controller 28' compares the unique identifier stored in random access memory 348' with the identifier included in the received message). If the message is not a new message, the method loops back to step 540 where another message is received by the local controller 28'. If the message is a new message, at step 544, the local controller 28' compares the category identifier, included in the received message, with the categories of desired information items in the previously loaded profile record from the profile file 500. Then, the local controller 28' determines whether or not the category identifier in the received message matches one of the categories of desired information items in the profile record. If not, the method loops back to step 540 where another message is received by the local controller 28'. If so, at step 546, the local controller 28' saves the message in a record in the message file. Note that the message identifier, extracted from the received message, and the date and time when the message was received are included in the stored record before the local controller 28' saves the record to the message file 502. Then, at step 548, the local controller 28' determines whether or not to continue retrieving messages from the broadcast data transport network 26'. If not, the method stops at step 550. If so, the method advances to step 538 where a determination is made as to whether or not the profile file 500 has been updated since the last message was received by the local controller 28'. If so, the updated profile record is retrieved at step 536. If not, the next message is received at step 540.

FIG. 34 shows a flow chart representation of the steps taken by the information delivery system 10' while executing the information production application 496 on the local controller 28'. After starting at step 560, the method advances to step 562 where the local controller 28' retrieves the profile record from the profile file 500 into random access memory 348'. Then, at step 564, the local controller 28' retrieves the first unplayed message in the message file 502. Note that unplayed messages are retrieved and played in an order, or priority, determined by the order of the category identifiers present in the profile record previously loaded into random access memory 348'. Therefore, the local controller 28' retrieves the first unplayed message having the highest priority, as determined by comparing the category identifier of each unplayed message to the highest priority category identifier in the profile record. Then, at step 568, the text-to-speech conversion application 498 is executed as a subroutine and the unplayed message is passed to the text-to-speech conversion application 498 for production of audio signals on audio signal channel 29' which are representative of the textual information present in the message. After execution of the text-to-speech conversion application 498 terminates, the message's record in the message file 502 is updated, at step 570, to reflect the date and time when the message was played by the local controller 28'. Then, at step 572, the local controller 28' determines whether or not there are more messages to be played by the local controller 28'. If not, the method stops at step 576. If so, at step 574, the local controller 28' retrieves the next unplayed message, using the category identifiers of the profile record to establish priority. Then, the method loops back to step 568 where the local controller 28' produces audio signals, on audio signal channel 29', for receipt by an end-user audio device 30'.

Whereas this invention has been described in detail with particular reference to its most preferred embodiments, it is understood that variations and modifications can be effected within the spirit and scope of the invention, as described herein before and as defined in the appended claims. The corresponding structures, materials, acts, and equivalents of all means or step plus function elements in the claims below are intended to include any structure, material, or acts for performing the functions in combination with other claimed elements as specifically claimed.

I claim:

1. A method of distributing information to an end-user in computer-readable textual form for subsequent conversion into audible form at an end-user location, the method comprising the steps of:

receiving at a collection site an information item, wherein the information item includes data in computer-readable textual form, and wherein the data includes a portion that will cause the generation of improperly spoken speech therefrom by a text-to-speech synthesizer positioned at an end-user location;

detecting at the collection site the portion of the data of the information item that will cause the generation of improperly spoken speech therefrom by the text-to-speech synthesizer;

replacing at the collection site the detected portion of the data of the information item with replacement data in computer-readable textual form that will cause the generation of properly spoken speech therefrom by the text-to-speech synthesizer; and, transmitting the information item from the collection site through a data channel to the end-user location for subsequent conversion into audible form by the text-to-speech synthesizer at the end-user location, wherein the transmitted information item includes the replacement data.

2. The method of claim 1, wherein the replacement data includes data in computer-readable textual form that is phonetically-equivalent to the detected portion of the data of the information item.

3. The method of claim 1, wherein the replacement data includes data in computer-readable textual form that corresponds to the detected portion of the data of the information item and that is intentionally misspelled to cause the generation of properly spoken speech therefrom by the text-to-speech synthesizer positioned at the end-user location.

4. The method of claim 1, wherein the method further includes a step of inserting into the data of the information item at the collection site data in computer-readable textual form that corresponds to punctuation which will cause the generation of properly spoken speech from the data of the information item by the text-to-speech synthesizer positioned at the end-user location.

5. The method of claim 1, wherein the data of the information item includes a reference to an illustration, and wherein the method further includes a step of editing the data of the information item at the collection site to remove the reference to the illustration from the data of the information item prior to transmitting the information item to the end-user location.

6. The method of claim 1, wherein the method further comprises the steps of receiving the transmitted information item at the end-user location, and synthesizing at the end-user location audible signals from the data of the received information item.

7. The method of claim 1, wherein the method further comprises the steps of receiving at the collection site a plurality of information items that include data in computer-readable textual form, wherein the information item is one information item of the plurality of information items, receiving at the collection site selection criteria from the end-user location, wherein the received selection criteria identifies a type of information item desired for receipt by an end-user at the end-user location, and, selecting at the collection site for transmission to the end-user location information items from the plurality of information items using the received selection criteria.

8. The method of claim 1, wherein the computer-readable textual form includes ASCII text.

9. A method of distributing information to an end-user in text form for subsequent conversion into audible speech at an end-user location, the method comprising the steps of:

receiving at a collection site an information item from an information provider, wherein the information item includes text data in a format suitable for input to a text-to-speech synthesizer at an end-user location and for conversion into audible speech thereby;

detecting at the collection site a portion of the text data of the information item that will cause the generation of improperly spoken speech therefrom by the text-to-speech synthesizer;

editing at the collection site the detected portion of the text data of the information item to produce an edited information item that will cause the generation of properly spoken speech therefrom by the text-to-speech synthesizer; and, communicating the edited information item from the collection site through a communication channel to the end-user location for subsequent input to the text-to-speech synthesizer for conversion into audible speech.

10. The method of claim 9, wherein the step of editing includes replacing the detected portion of the text data of the information item with text data in a format suitable for input to the text-to-speech synthesizer that is phonetically-equivalent to the detected portion of the text data.

11. The method of claim 9, wherein the step of editing includes inserting into the text data of the information item additional text data corresponding to punctuation.

12. The method of claim 9, wherein the method further includes the steps of receiving at the collection site a plurality of information items that include text data in a format suitable for input to the text-to-speech synthesizer at the end-user location and for conversion into audible speech thereby, wherein the information item is one information item of the plurality of information items, receiving at the collection site selection criteria from the end-user location, wherein the received selection criteria identifies a type of information item desired for receipt by an end-user at the end-user location, and, selecting at the collection site for communication to the end-user location information items from the plurality of information items using the received selection criteria.

13. A computer program residing on a media, said computer program having a plurality of instructions executable by a computer for distributing information to an end-user in text format for subsequent conversion into audible speech by a text-to-speech synthesizer at an end-user location, said plurality of instructions for directing the computer to perform the steps of:

receiving at a collection site an information item, wherein the information item includes text data, and wherein the text data includes a portion that will cause the generation of improperly spoken speech therefrom by a text-to-speech synthesizer located at an end-user location;

detecting at the collection site the portion of the text data of the information item that will cause the generation of improperly spoken speech therefrom by the text-to-speech synthesizer;

replacing at the collection site the detected portion of the text data of the information item with replacement text data that will cause the generation of properly spoken speech therefrom by the text-to-speech synthesizer; and, transmitting the information item from the collection site through a data channel to the end-user location for subsequent conversion into audible speech by the text-to-speech synthesizer, wherein the transmitted information item includes the replacement text data.

* * * * *